US007400708B2

(12) United States Patent
Takahashi et al.

(10) Patent No.: US 7,400,708 B2
(45) Date of Patent: Jul. 15, 2008

(54) X-RAY GENERATOR AND X-RAY CT APPARATUS COMPRISING SAME

(75) Inventors: Jun Takahashi, Nagarcyama (JP); Takuya Domoto, Noda (JP); Hiroshi Takano, Moriya (JP)

(73) Assignee: Hitachi Medical Corporation, Tokyo (JP)

( * ) Notice: Subject to any disclaimer, the term of this patent is extended or adjusted under 35 U.S.C. 154(b) by 0 days.

(21) Appl. No.: 10/527,161

(22) PCT Filed: Sep. 5, 2003

(86) PCT No.: PCT/JP03/11358

§ 371 (c)(1),
(2), (4) Date: Nov. 22, 2005

(87) PCT Pub. No.: WO2004/036963

PCT Pub. Date: Apr. 29, 2004

(65) Prior Publication Data

US 2006/0165220 A1 Jul. 27, 2006

(30) Foreign Application Priority Data

Sep. 9, 2002 (JP) ..... 2002-262354

(51) Int. Cl.
*H05G 1/10* (2006.01)

(52) U.S. Cl. ..... 378/109; 378/101

(58) Field of Classification Search ..... 378/105–110, 378/104, 101

See application file for complete search history.

(56) References Cited

U.S. PATENT DOCUMENTS 5,128,592 A * 7/1992 Dean et al. ..... 315/224
2001/0008552 A1* 7/2001 Harada et al. ..... 378/107

FOREIGN PATENT DOCUMENTS

| | | |
|---|---|---|
| CN | 1126578 | 7/1996 |
| JP | 05-307998 | 11/1993 |
| JP | 5-307998 | * 11/1993 |
| JP | 05-315085 | 11/1993 |
| JP | 08-255694 | 10/1996 |

OTHER PUBLICATIONS

Chinese Office Action dated Feb. 2, 2007.

* cited by examiner

*Primary Examiner*—Hoon Song
(74) *Attorney, Agent, or Firm*—Antonelli, Terry, Stout & Kraus, LLP.

(57) ABSTRACT

In an X-ray generating device of the neutral grounding system, to remove an unbalance voltage generated due to difference in impedance of parallel transformer coils of the high voltage transformer and particularly an unbalance voltage involved with difference in impedance above and below the neutral points generated in a metal X-ray tube, a plurality of currents flowing in opposite directions through primary windings of the parallel transformer coils in the high voltage transformer are passed through by or wound around a common toroidal coil or wound around an outer circumference of the toroidal coil at a predetermined ratio of winding number, and the unbalance voltage occurring to the secondary side is cancelled by changing primary current with magnetic behavior.

16 Claims, 11 Drawing Sheets

X-RAY GENERATOR AND X-RAY CT APPARATUS COMPRISING SAME

TECHNICAL FIELD

The present invention relates to an X-ray generating device and an X-ray CT apparatus using it, more particularly to a technique with which stability, and reliability of the device can be maintained by equalizing voltage between an anode and an earth and that between a cathode and the earth of an X-ray tube in a miniaturized and lightweighted X-ray generating device. Further, it relates to an X-ray CT apparatus which can realize rapid scan by mounting this X-ray generating device on a scanner of the X-ray CT apparatus.

BACKGROUND OF THE INVENTION

An image diagnostic apparatus using X-rays is designed to radiate X-rays generated from an X-ray generating device to an object to be examined, and detect and image a dose of X-rays which passes through the object. To generate X-rays from an X-ray tube device, DC high voltage is applied between an anode and a cathode of the X-ray tube device, and thermal electrons generated by heating the cathode to a high temperature are accelerated with DC high voltage and collided with the anode. Accordingly, a high voltage power supply for supplying the DC high voltage between the anode and the cathode is necessary.

As for this kind of X-ray high voltage device, an inverter-type high voltage device is generalized, which is greatly superior in point of device miniaturization and performance. It is currently used in almost all kinds of X-ray image diagnostic apparatus including a general X-ray imaging apparatus, an X-ray imaging apparatus for angiography, an X-ray CT apparatus, and the like.

FIG. 9 shows an example of main circuitry of the inverter-type X-ray high voltage device, in which a voltage supplied from DC power supply 1 is converted into a high-frequency AC voltage in full-bridge inverter circuit 2 having power semiconductor switching elements, e.g. insulated bipolar transistors 21, 22, 23, and 24, this AC voltage is boosted in high voltage transformer 3, converted into a DC high voltage in high voltage rectifier 4, and applied to X-ray tube 5. Primary windings of high voltage transformer 3 are formed such that two primary windings including first primary winding 3*a* and second primary winding 3*b* are connected in parallel on the output side of inverter circuit 2 in order to secure current capacity.

Further, secondary windings of high voltage transformer 3 include first secondary winding 3*c* and second secondary winding 3*d*. An output voltage of first secondary winding 3*c* is converted into first DC high voltage Va in first high voltage rectifier 4*a* and applied between anode 5*a* and an earth of X-ray tube 5. An output voltage of second secondary winding 3*d* is converted into second DC high voltage Vk in second high voltage rectifier 4*b* and applied between cathode 5*b* and the earth of X-ray tube 5. A negative side of DC voltage output terminals of first high voltage rectifier 4*a* and a positive side of DC output terminals of second high voltage rectifier 4*k* are connected in series, and the junction is grounded to the earth. This neutral grounding system is employed in the circuit.

By employing the above-described neutral grounding system, a voltage (tube voltage) between the anode and cathode of X-ray tube 5 can be divided into halves to be applied respectively between the anode and the earth and between the earth the cathode. Accordingly, it becomes easy to secure withstand voltage of the high voltage transformer and the high voltage rectifier. However, in the neutral grounding system, unbalance occurs between first DC high voltage Va and second DC high voltage Vk in some cases, and (1) and (2) listed below are the main reasons:

(1) In a glass X-ray tube and in a metal X-ray tube, difference occurs between Va and Vk due to difference between impedances of two pairs of circuits respectively for obtaining voltage Va applied between the anode and the earth and for obtaining voltage Vk applied between the earth and the cathode (impedance of a first circuit including first primary winding 3*a* and first secondary winding 3*c* and impedance of a second circuit including second primary winding 3*b* and second secondary winding 3*d* of high voltage transformer 3).

(2) In a metal X-ray tube, difference occurs between Va and Vk due to difference between load impedances respectively applied Va and Vk (impedance between anode 5*a* and the earth of X-ray tube 5 to which Va is applied and impedance between the earth and the cathode to which Vb is applied). Meanwhile, this phenomenon does not occur in the glass X-ray tube.

For example, in an X-ray device whose maximum tube voltage is 150 kV, the withstand voltage of secondary windings of the high voltage transformer and the voltage of an anode and a cathode to the earth of the X-ray tube can be usually estimated to be 75 kV being the half of the maximum tube voltage. However, because a voltage larger than the rating is applied between the anode and the earth or between the cathode and the earth when the above mentioned unbalance voltage occurs and becomes large, the withstand voltage not only of the X-ray tube but also of the high voltage transformer, the high voltage rectifier, and high voltage parts attaching thereto has to be set higher.

Further, an inner space called creepage distance between the high voltage parts and a housing for containing them also have to be made long in accordance with the withstand voltage. For those reasons, the apparatus is obliged to be made large when the unbalance voltage occurs, which becomes an obstacle to the above mentioned miniaturization. Particularly, it becomes a big obstacle to an X-ray CT apparatus which mounts the X-ray high voltage device on a scanner and which aims at the rapid scan or aims to reduce the number of unit of system.

Japanese unexamined patent publication No.Hei.3-101098 discloses a technique of recognizing and solving the unbalance voltage due to (2) difference in load impedance of the metal X-ray tube. This technique is designed to adjust the unbalance voltage in the metal X-ray tube of the neutral grounding system by switching a reactor of one of the plurality of primary windings of the transformer. The adjustment is done by switching the reactor with a switch while measurement is performed. Therefore, the adjustable range is stepwise and it is necessary to switch the reactor in accordance with the X-ray tube. The above adjustment cannot be performed in the X-ray device on which this X-ray generating device is mounted while the tube voltage is actually applied to the X-ray tube to perform imaging. Accordingly, the adjustment had to be done regularly.

SUMMARY OF THE INVENTION

The present invention is done in consideration of the above, and its object is to provide an X-ray generating device of the neutral grounding system which can equalize a voltage between an anode and an earth and a voltage between a cathode and the earth even when difference occurs in impedance of the above high voltage transformer and in load impedance, and to provide an X-ray CT apparatus mounting the above X-ray generating device on its scanner which can realize rapid scan. That is, according to a first feature of the present invention, an X-ray generating device includes: a high voltage transformer for boosting an AC power-voltage including a plurality of primary windings connected in parallel to an AC power supply, at least one iron core, and a plurality of secondary windings respectively corresponding to the primary windings; a plurality of high voltage rectifier circuits which are connected to outputs of the plurality of secondary windings of the high voltage transformer and converts the outputs into DC outputs, connects the DC in series, and grounds the midpoints of the series connection at a neutral point; and an X-ray tube receiving a predetermined tube voltage through a cathode and an anode thereof, respectively connected to a DC output negative terminal and a DC output positive terminal on both ends of the plurality of high voltage rectifier circuits, wherein a ratio obtained by dividing a plurality of values of currents respectively flowing through the plurality of primary windings each other at an identical time point is always kept at a predetermined ratio While the tube voltage is applied.

Removal of the unbalance voltage due to (1) difference in impedance of the high voltage transformer mentioned in the section of background art is achieved by the following means.

That is, according to a second feature of the present invention, in the X-ray generating device based on the first feature the predetermined ratio is 1 and the predetermined ratio is kept by waveform phase difference removing means which removes difference in waveform and phase occurring between the plural currents respectively flowing through the plural primary windings.

According to a third feature of the present invention, in the X-ray generating device based on the second feature the waveform phase difference removing means has a hollowed core made of a ferromagnetic material of large permeability, and a part of the plurality of conductors connecting the primary windings with the AC power supply passes through or turns around the hollow, and differences in waveforms and phases are removed by mutually canceling magnetic fields generated due to the primary winding currents. Here, "AL value" is a characteristic value of the core obtained by normalizing for 1 turn the inductance value obtained when the conductor is wound around the core for N turns, the unit being $iH/N^2$.

According to a fourth feature, in the X-ray generating device based on the third feature the core has a high AL value, and gives an inductance equivalent to or larger than a leakage inductance of the high voltage transformer. Here, "AL value" is a characteristic value of the core obtained by normalizing for 1 turn the inductance value obtained when the conductor is wound around the core for N turns, the unit being $iH/N^2$.

According to a fifth feature of the present invention, in the X-ray generating device based on the first feature the AC power supply includes a DC power supply and an inverter for converting a current from the DC power supply into a high-frequency AC current. By using the inverter to make the frequency of the AC power supply higher than a commercial frequency, the X-ray generating device is miniaturized and lightweighted. Further, by mounting it on the scanner, an X-ray CT apparatus of rapid scan is realized.

According to a sixth feature, in the X-ray generating device based on the first feature the X-ray tube is a metal X-ray tube having a metallic part in a substantial center and the metallic part is connected to the grounded neutral point.

Next, removal of the unbalance voltage due to the difference in load impedance mentioned in section (2) of the background technique, i.e. current addition means is achieved by the following means.

That is, according to a seventh feature of the present invention, in the X-ray generating device based on the first feature the predetermined ratio is smaller than 1.

According to an eighth feature of the present invention, the X-ray generating device based on the seventh feature further includes current addition means formed by commonly winding two or more conductors among the plurality of conductors respectively connecting the plural primary windings with the AC power supply around a ferromagnetic core having a large permeability to keep the ratio between the plural current values are kept at a predetermined ratio.

According to a ninth feature of the present invention, in the X-ray generating device based on the eighth feature the core has a high AL value and gives an inductance equivalent to or larger than a leakage inductance of the high voltage transformer. Here, "AL value" is a characteristic value of the core obtained by normalizing for 1 turn the value of inductance obtained when a conductor is wound around the core for N turns, the unit being $iH/N^2$.

Further, if it is possible to reduce both the unbalance voltage due to difference in the circuit impedance and the unbalance voltage due to difference in the load impedance, the reduction effect is increased in comparison with the case that either of them is individually reduced. That is, it is achieved by the following means using both the waveform phase difference removing means and the current addition means.

That is, according to a tenth feature of the present invention, the X-ray generating device based on the sixth feature further includes waveform phase difference removing means which lowers the predetermined ratio to be smaller than 1 and removes differences in waveform and phase generated between the plural currents respectively flowing through the plurality of primary windings; and current addition means formed by commonly winding two or more conductors among the plural conductors respectively connecting the plurality of primary windings with the AC power supply around the ferromagnetic core having a large permeability, wherein the ratio between the plural current values is kept at a predetermined ratio by the waveform phase difference removing means and the current addition means.

According to an eleventh feature of the present invention, in the X-ray generating device based on the tenth feature the waveform phase difference removing means has a hollowed core made of ferromagnetic material of a large permeability, a part of the plurality of conductors passes through or turns around the hollow, and the differences in waveforms and phases are removed by mutually canceling magnetic fields generated by the primary current.

According to a twelfth feature of the present invention, in the X-ray generating device based on the eleventh feature the two cores have a high AL value and give an inductance equivalent to or larger than a leakage inductance of the high voltage transformer. Here, "AL value" is a characteristic value of the core obtained by normalizing for one turn the value of inductance obtained when a conductor is wound around the core for N turns, the unit being $iH/N^2$.

Further, the objects are achieved by an X-ray CT apparatus including the X-ray devices having the above features.

According to a thirteenth feature, the present invention can provide an X-ray CT apparatus including the X-ray generating device mentioned in the first feature, an X-ray detector arranged opposite to the X-ray tube, a rotative circular plate holding-the X-ray tube and the X-ray detector, and being driven to rotate around an object to be examined, and image reconstructing means for reconstructing a tomogram of the object as an image on the basis of strength of X-rays detected by the X-ray detector.

According to a fourteenth feature, the present invention can provide an X-ray CT apparatus including the X-ray generating device mentioned in the fifth feature, an X-ray detector arranged opposite to the X-ray tube, a rotative circular plate holding the X-ray tube and the X-ray detector, and being driven to rotate around an object to be examined, and an image reconstructing means for reconstructing a tomogram of the object as an image on the basis of strength of X-rays detected by the X-ray detector.

According to a fifteenth feature, the present invention can provide the X-ray generating device mentioned in the seventh feature, an X-ray detector arranged opposite to the X-ray tube, a rotative circular plate holding the X-ray tube and the X-ray detector, and being driven to rotate around an object to be examined, and image reconstructing means for reconstructing a tomogram of the object as an image on the basis of strength of X-rays detected by the X-ray detector.

According to a sixteenth feature, the present invention can provide an X-ray CT apparatus including the X-ray generating device mentioned in the tenth feature, an X-ray detector arranged opposite to the X-ray tube, a rotative circular plate holding the X-ray tube and the X-ray detector, and being driven to rotate around an object to be examined, and image reconstructing means for reconstructing a tomogram of the object as an image on the basis of strength of X-rays detected by the X-ray detector.

BRIEF DESCRIPTION OF THE DRAWINGS

FIGS. 11*a* and 11*b* are diagrams showing waveforms of currents flowing through primary windings of the high voltage transformer for illustrating a common mode current generated due to the difference in impedance of the high voltage transformer, wherein FIG. 11*a* shows the case that the common mode current exists and FIG. 11*b* shows the case that the common mode current does not exist.

BEST MODE FOR CARRYING OUT THE INVENTION

Hereinafter, embodiments of the present invention will be described in detail with reference to accompanying drawings. Although the embodiments of the present invention can be applied to all X-ray generating devices of the neutral grounding system, the following embodiments are described with regard to an X-ray generating device-using an inverter-type X-ray high voltage device.

Embodiment 1

In this embodiment, an X-ray high voltage device which can remove the unbalance voltage due to (1) difference in impedance of a high voltage transformer mentioned in the section of the background technique will be described.

Figure 9:
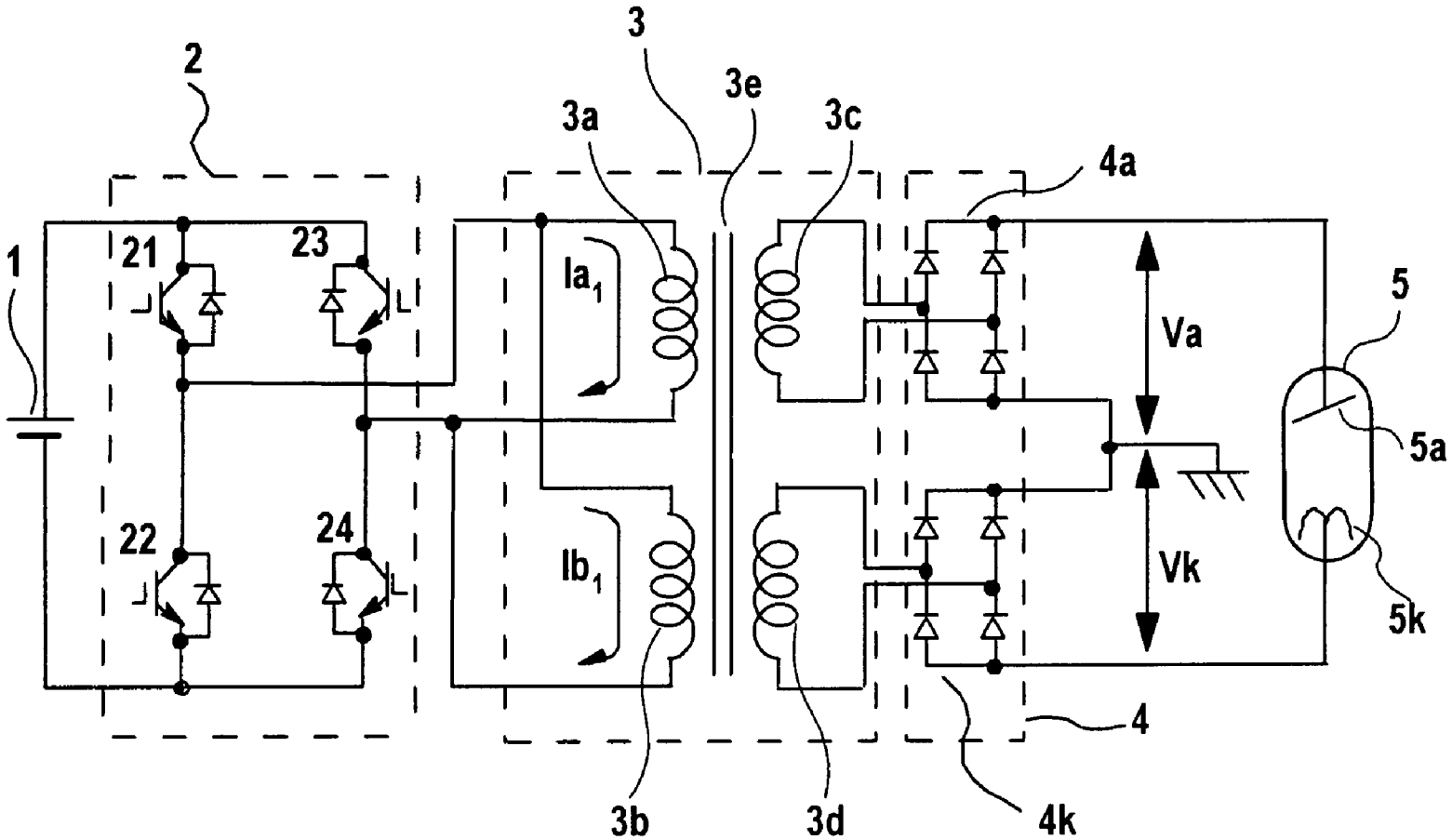
FIG. 9 is a diagram showing an example of main circuitry of a conventional X-ray generating device.

The reason of generation of the difference between Va and Vk (hereinafter referred to as "unbalance voltage") due to the difference in impedance of the high voltage transformer mentioned at (1) will be analyzed, then solving means will be subsequently described. FIG. 9 shows an X-ray generator using a metal X-ray tube. In this high voltage transformer 3, because voltage difference between secondary windings 3*c* and 3*d* on a high voltage side and primary windings 3*a* and 3*b* on a low voltage side is very large, primary windings 3*a* and 3*b* and secondary windings 3*c* and 3*d* are detached at a predetermined distance and an insulator is inserted therebetween. A part of generated magnetic flux passes through between primary windings 3*a* and 3*b* and secondary windings 3*c* and 3*d* and between each of those windings and iron core 3*e*, and becomes a leakage magnetic flux.

Therefore, it can be considered that first primary winding 3*a* and secondary winding 3*c* form one transformer (hereinafter thus formed transformer is referred to as "first transformer"), and second primary winding 3*b* and secondary winding 3*d* form another transformer (hereinafter thus formed transformer is referred to as "second transformer"). In the high voltage transformer of this structure, the above leakage magnetic flux works as a leakage inductance. Because a winding number ratio of the high voltage transformer is very high (several hundreds to a thousand and several hundreds), the winding number of secondary windings 3*c* and 3*d* is very large and the windings are wound for several dozen layers.

Figure 10:
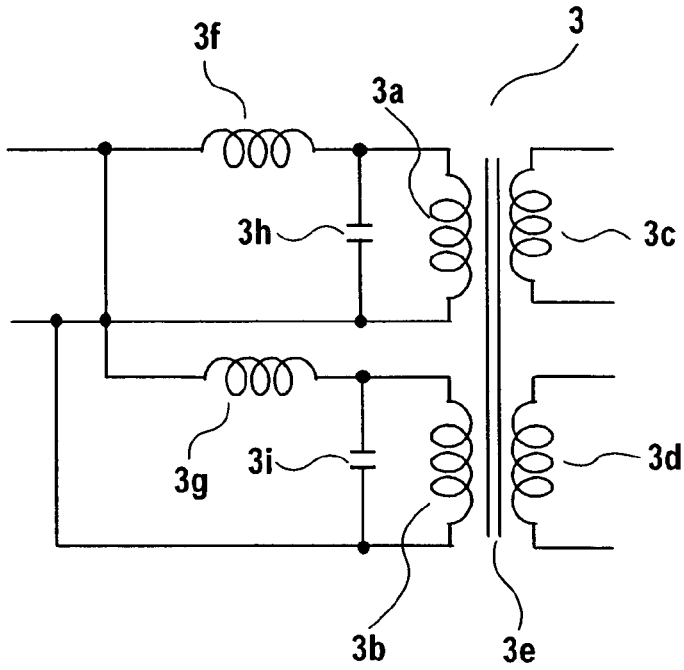
FIG. 10 is a diagram showing an equivalent circuit of a high voltage transformer for illustrating the unbalance voltage generated due to difference in impedance of the high voltage transformer.
Figure 11A:
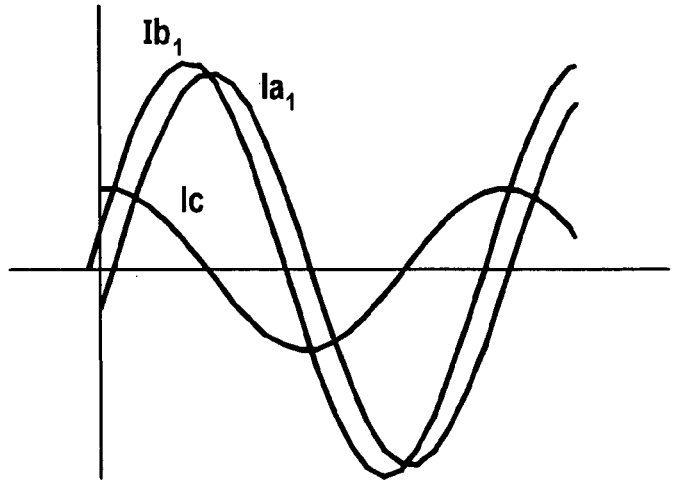
Figure 11B:
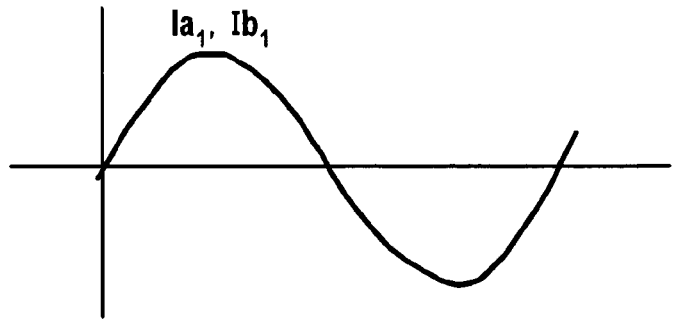

Between those layers is generated stray capacitance. When parasitic impedances of those leakage inductances and stray capacitance is seen from the primary side of high voltage transformer 3, equivalently, leakage inductances 3*f* and 3*g* are connected in series to the respective primary windings and stray capacitances 3*h* and 3*i* are connected in parallel to the respective primary windings, as shown in FIG. 10. If the high voltage transformer in which such parasitic impedance of the leakage inductance and stray capacitance exists is used in an X-ray high voltage device of the neutral grounding system and the difference occurs between impedance of the first transformer and impedance of the second transformer, difference also occurs in waveform and phase of current Ia1 flowing through the primary side of the first transformer (corresponding to current flowing through the side of anode 5*a* of X-ray tube 5) and current Ib1 flowing through the primary side of the second transformer (corresponding to current of the side of cathode 5*b* of X-ray tube 5) as shown in FIG. 11(*a*).

This difference occurs because of the difference between the waveform and phase of first resonance current due to leakage inductance 3*f* and stray capacitance 3*h* of the first transformer and those of second resonance current due to leakage inductance 3*g* and stray capacitance 3*i* of the second transformer. Accordingly, the difference is not generated when leakage inductance 3*f* and 3*g* and stray capacitance 3*h* and 3*i* are respectively equalized.

However, it is difficult to completely equalizing each of them because the difference in inductance and capacitance is generated because of a gap between first primary winding 3*a* and second primary winding 3*c* and between first secondary winding 3*b* and second secondary winding 3*d* made in manufacturing or various sizes such as a diameter of primary and secondary windings, and the like. When difference thus occurs in waveform and phase between current Ia1 flowing through the primary side of the first transformer and current Ib1 flowing through the primary side of the second transformer, difference simultaneously occurs between voltage Va applied between an anode and an earth of X-ray tube 5 and voltage Vk applied between a cathode and the earth which are obtained by rectifying the secondary winding voltages of the first and second transformers induced by magnetic flux generated by those currents. Hereinafter, a difference component in waveform and phase between current Ia1 flowing through the primary side of the first transformer and current Ib1 flowing through the primary side of the second transformer, i.e. (Ia1-Ib1) or its absolute value is referred to as "waveform phase difference" or "common mode current".

Particularly in the method of controlling the tube voltage, by raising a DC power voltage of the inverter circuit and controlling a conducting width of this circuit in order to reduce the current of the inverter circuit and the winding number ratio of the high voltage transformer and miniaturize the whole body of the devise, the conducting width has to be made very small in a light load area where the tube voltage is small. In this case, because a first resonance frequency due to leakage inductance 3*f* and stray capacitance 3*h* and a second resonance frequency due to leakage inductance 3*g* and stray capacitance 3*i* are higher than the operating frequency of inverter 2 by around one digit, large difference occurs between the power supplied between the anode and the earth and the power supplied between the cathode and the earth which are products of those currents and output voltage of inverter 2, i.e. voltage Va between the anode and the earth and voltage Vk between the cathode and the earth even when there is only a little difference between the first resonance frequency and the second resonance frequency.

This unbalance voltage is small when the DC power supply voltage of inverter circuit is not as high as in conventional one, and so it does not become a serious problem. However, when the DC power supply voltage of the inverter circuit is raised as above, a variable range of conducting width of switching elements in the inverter circuit becomes wider than that in the conventional inverter circuit. Accordingly, the unbalance voltage cannot be neglected in the light load area with a narrow conducting width.

Figure 12:
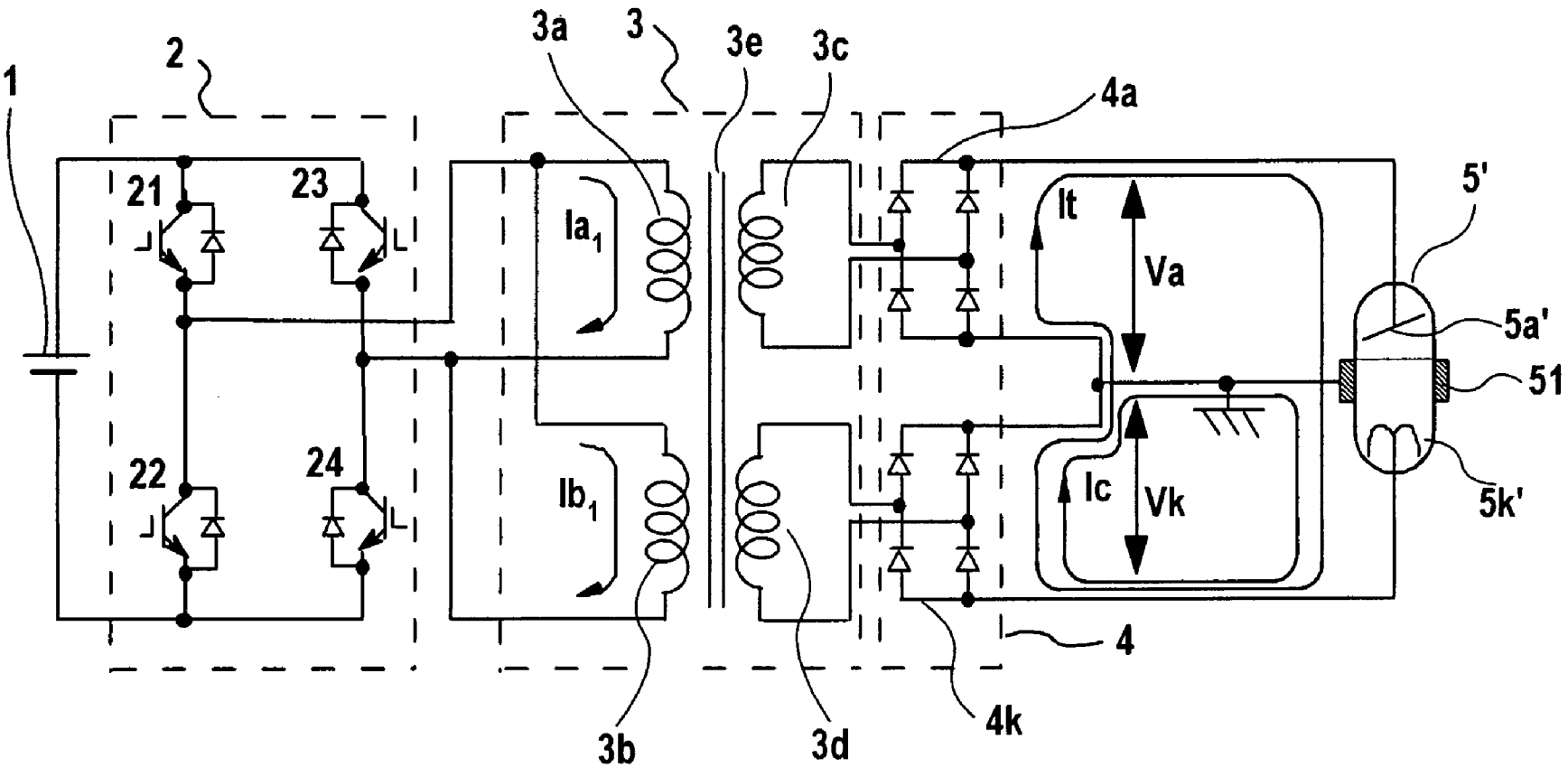
FIG. 12 is a diagram showing a structure of a conventional X-ray generating device using a metal X-ray tube.

Meanwhile, although the above is the description mainly for the glass X-ray tube, similar common mode current is generated also in the case of using a metal X-ray tube, a part of container of which is made of metal and is connected to the earth as shown in FIG. 12.

Figure 1:
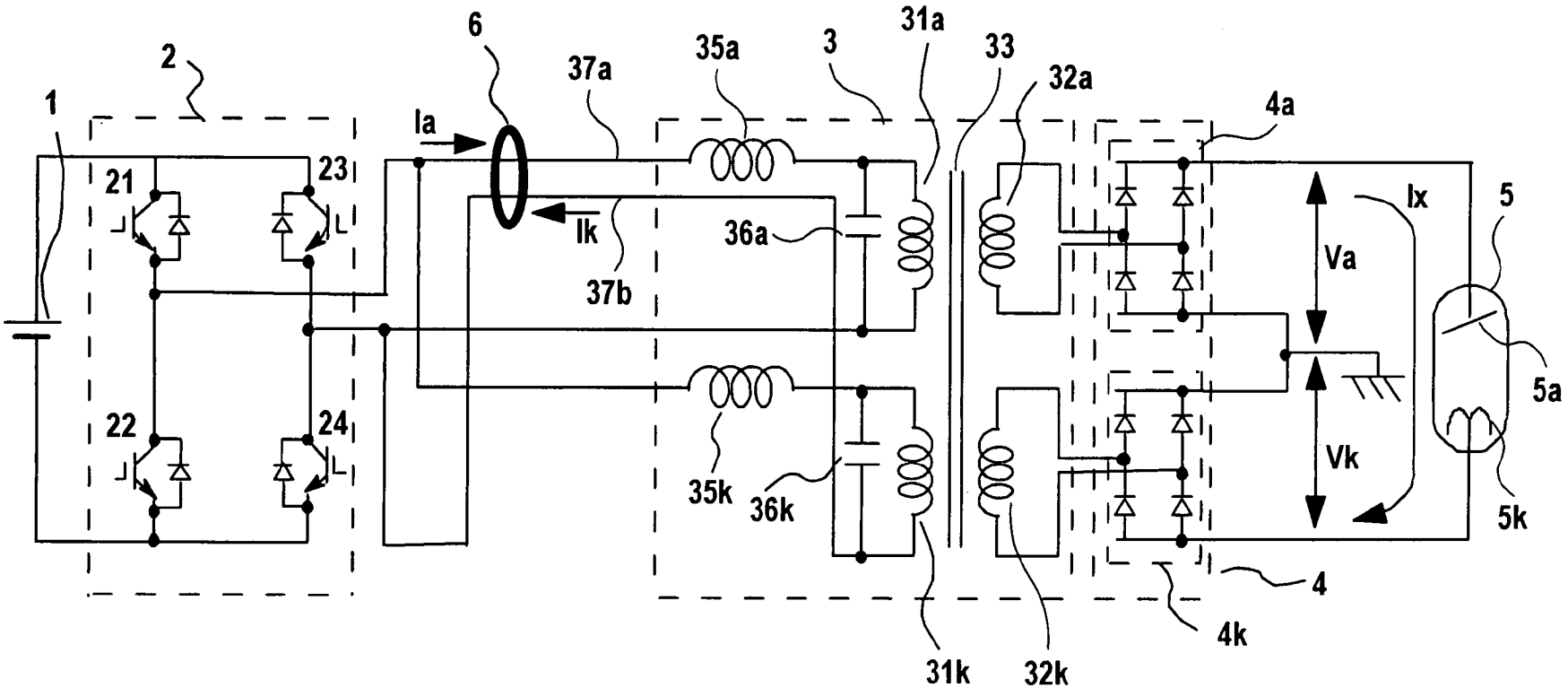
FIG. 1 is a diagram showing a structure according to Embodiment 1 of the present invention for removing unbalance voltage generated due to difference in impedance of a high voltage transformer of an X-ray generating device.

Embodiment 1 of the present invention will be described with reference to FIG. 1. FIG. 1 is a schematic diagram of an inverter-type X-ray high voltage device whose main object is to remove the unbalance voltage generated due to impedance difference of the high voltage transformer.

This X-ray high voltage device is designed to convert a DC voltage into a high-frequency AC voltage using an inverter circuit, boost its output voltage in a high voltage transformer, rectify the voltage to apply to an X-ray tube, and radiate X-rays. As shown in the figure, it includes DC power supply 1, full-bridge inverter circuit 2 having insulated gate bipolar transistors (hereinafter abbreviated as "IGBT") IGBTs 21 to 24 being electric semiconductor switching elements, high voltage transformer 3, high voltage rectifier 4, and X-ray tube 5.

While in this embodiment the X-ray tube may be either a glass X-ray tube or a metal X-ray tube, FIG. 1 shows the case of the glass X-ray tube. In the figure, reference number 4*a* represents a first high voltage rectifier, reference number 4*k* represents a second high voltage rectifier, reference number 5*a* represents an anode, reference number 5*k* represents a cathode, reference number 6 represents a common mode current removing core, reference number 31*a* represents a first primary winding, reference number 31*k* represents a second primary winding, reference number 32*a* represents first secondary winding, reference number 32*k* represents a second secondary winding, reference number 33 represents an iron core, reference number 35*a* represents a first leakage inductance, reference number 35*k* represents a second leakage inductance, reference number 36*a* represents a first stray capacitance, reference number 36*k* represents a second stray capacitance, reference number 37*a* represents a first bonding conductor, reference number 37*b* represents a second bonding conductor, reference character Ix represents a tube current, reference character Va represents an anode voltage, reference character Vk represents a cathode voltage, reference character Ia represents a resonance current on the anode side, and reference character Ik represents a resonance current on the cathode side.

Next, the function of the above components will be briefly described. DC power supply 1 is means for supplying a DC voltage, which may be, e.g. a buttery, or means for obtaining a DC voltage by rectifying AC commercial power supply of 50 Hz or 60 Hz and smoothing it with smoothing elements such as condenser, e.g. a rectifying circuit using a diode or thyristor, or an converter circuit using e.g. a pulse width modulation control disclosed in Japanese Unexamined Patent Publication No.Hei.7-65987 having a boosting function applied IGBT.

In this case, by using the converter circuit having a pulse width modulation control disclosed in this publication, the DC power supply voltage of the inverter circuit can be raised, and phases of a phase voltage and of a phase current of the commercial AC power supply can be equalized so that the power factor becomes around 1. Accordingly, it has an advantage that reactive current is greatly reduced in comparison with a converter circuit system using the rectifying circuit including a diode or thyristor, and it becomes possible to reduce power supply installed capacity.

Inverter 2 is designed to receive a DC voltage output from DC power supply 1, convert it into a high-frequency AC voltage, and control the voltage applied to X-ray tube 5 (hereinafter "tube voltage").

High voltage transformer 3 is designed to boost output AC voltage of inverter 2, and its primary windings are connected to the output side of inverter 2. Here, to maintain sufficient current capacitance and to supply large power at a high frequency, first primary winding 31*a* and second primary winding 31*k* are connected in parallel and wound around two pins of U-U shaped cut core.

Meanwhile, the secondary windings are wound correspondingly to primary windings 31*a* and 31*k* of each pin. First secondary winding 32*a* generates the tube voltage on the anode side with respect to earth potential, and second secondary winding 32*k* generates the tube voltage on the cathode side with respect to the earth potential.

Figure 2:
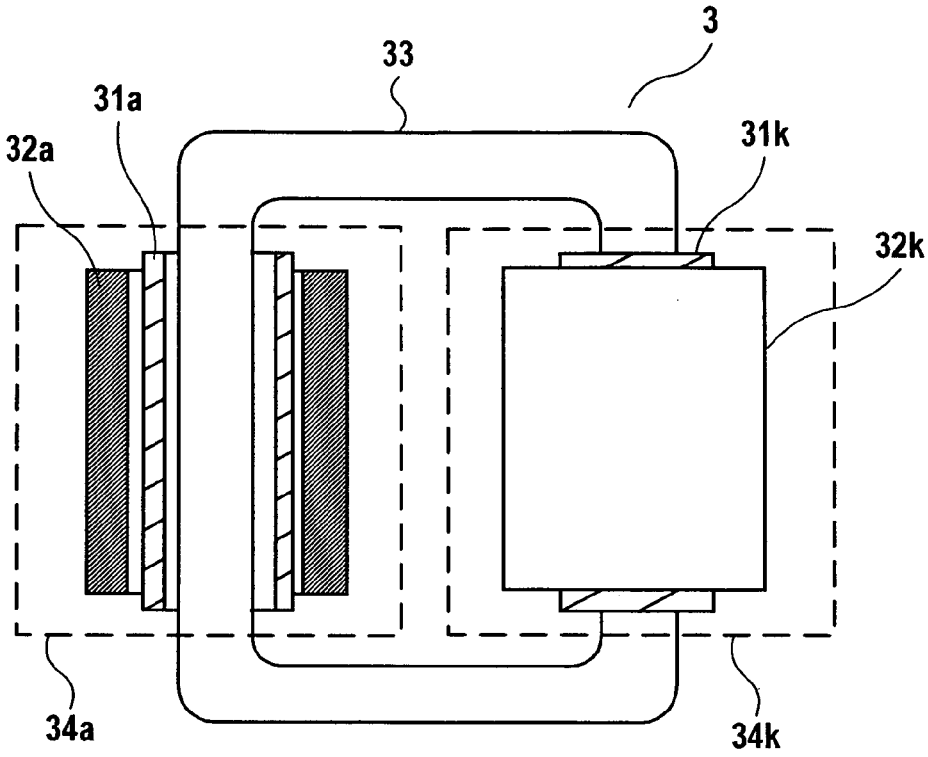
FIG. 2 is a partial cross sectional diagram showing a structure of the high voltage transformer of FIG. 1.

FIG. 2 is a diagram showing a structure (partial cross section) of the transformer of FIG. 1. Pin 34*a* of iron core (U-U core) 33 having a figure-of-O side shape is wound first primary winding 31*a* and first secondary winding 32*a*, and another pin 34*k* is wound second primary winding 31*k* and second secondary winding 32*k*. In high voltage transformer 3 used in the X-ray high voltage device, a predetermined distance has to be retained and an insulator (not shown in the figure) has to be inserted respectively between primary windings 31*a* and 31*k* and between secondary windings 32*a* and 32*k* because voltage difference between the secondary windings to be the high voltage side and the primary windings to be the low voltage side becomes very large.

For this reason, there is a characteristic that a leakage magnetic flux is easily generated as a part of magnetic flux passes through between primary windings 31*a* and 31*k* and between secondary windings 32*a* and 32*k*, or between each winding and iron core 33. This leakage magnetic flux works as leakage inductances 35*a* and 35*k*, which are equivalently connected in series respectively to first windings 31*a* and 31*k*.

Further, because the winding number ratio is very large (several hundreds to a thousand and several hundreds) in the high voltage transformer, the winding number of secondary windings 32*a* and 32*k* is huge and they are wound for over several dozen layers. Therefore, between those layers are generated stray capacitances 36*a* and 36*k*. Seen from the primary side, they are equivalently connected in parallel to the output of the secondary windings. In this manner, a part of the generated magnetic flux does not pass through the iron core, and it can be apparently regarded that first primary winding 31*a* and secondary winding 32*a* form one transformer, and second primary winding 31*k* second winding 32*k* form another transformer.

High voltage rectifier 4 is designed to receive a high-frequency AC high voltage from high voltage transformer 3 and convert it into a DC, which includes first high voltage rectifier 4*a* for receiving an output voltage from the first secondary winding and second high voltage rectifier 4*k* for receiving an output voltage from the second secondary winding. First high voltage rectifier 4*a* applies a voltage to the anode side of the X-ray tube with respect to the earth, and the second high voltage rectifier 4*k* applies a voltage to the cathode side with respect to the earth.

X-ray tube 5 is designed to radiate X-rays when a DC high voltage from high voltage rectifier 4 is applied thereto, which includes cathode 5*k* for generating thermal electrons and anode 5*a* for generating X-rays as the thermal electrons from cathode 5*k* are collided therewith. Anode 5*a* is connected to the output side of first high voltage rectifier 4*a* and cathode 5*k* is connected to the output side of second high voltage rectifier 4*k*. Reference number 6 represents a first core being waveform phase difference removing means for removing the unbalance voltage due to impedance difference of high voltage transformer 3.

Next, operations of thus constructed inverter-type X-ray high voltage device will be described. First, in FIG. 1, a DC voltage of DC power supply is converted into an AC voltage by inverter 2. Next, the AC voltage output from inverter 2 is applied to the first resonance circuit including first leakage inductance 35*a* and first stray capacitance 36*a*, and resonance current Ia flows.

After that, the AC voltage is output from first secondary winding 32*a* due to resonance current Ia, then converted into a DC by first rectifier 4*a*, and current Ix flowing from the side of anode 5*a* to the side of cathode 5*k* of X-ray tube 5 being a load is supplied.

At the same time, the AC voltage output from inverter 2 is applied to the second resonance circuit including second leakage inductance 35*k* and second stray capacitance 36*k*. After that, the AC voltage is output from second secondary winding 32*k* due to resonance current Ik, then converted into a DC by second rectifier 4*k*, and current Ix flowing from the side of anode 5*a* to the side of cathode 5*k* of X-ray tube 5 being a load is supplied.

Here, an inductance of first leakage inductance 35*a* seen from the output side of inverter 2 being a common voltage supply is represented by reference character La, an inductance of second leakage inductance 35*k* is represented by reference character Lk, a capacitance of first stray capacitance 36*a* is represented by reference character Ca, and a capacitance of second stray capacitance 36*k* is represented by reference character Ck. Further, a load resistance on the anode side of the X-ray tube is represented by reference character Ra, that on the cathode side is represented by reference character Rk (usually Ra=Rk), and an angular frequency of output voltage of inverter 2 being the voltage supply is represented by reference character ω. Here, phases of currents Ia and Ik with respect to the voltage supply can be expressed respectively by the following formulas:

$$\text{Phase of } Ia\text{: } -\tan^{-1}[\{\omega\cdot La-(\omega\cdot Ca)^{-1}\}/Ra] \quad (1)$$

$$\text{Phase of } Ik\text{: } -\tan^{-1}[\{\omega\cdot Lk-(\omega\cdot Ck)^{-1}\}/Rk] \quad (2)$$

Accordingly, when variations occur in manufacturing between first primary winding 31*a* and second primary winding 31*k* and between first secondary winding 32*a* and second secondary winding 32*k*, difference occurs between the phase of first resonance current Ia1 and the phase of second resonance current Ik1 (Ia and Ik respectively corresponds to Ia1 and Ib1) as shown in FIG. 11.

This difference in the phase greatly affects the output voltage of the secondary windings even when difference in resonance current waveform is a little under the imaging condition where a conducting width of switching elements 21 to 24 of inverter 2 is small, i.e. under the condition of light load with a large tube voltage and a small tube current. Accordingly, a large unbalance voltage is brought between the tube voltage on the anode side and the tube voltage on the cathode side. When such unbalance voltage is generated and becomes large, a voltage larger than the rating is applied between the anode and the earth or between the cathode and the earth, and the withstand voltage of the X-ray voltage, the high voltage transformer, the high voltage rectifier, and other high voltage parts attaching them has to be accordingly raised. Therefore, the device becomes large, which becomes an obstacle to the above-mentioned miniaturization.

Therefore, first core 6 is provided as waveform phase difference removing means for canceling the above described unbalance voltage.

Hereinafter, operations thereof will be described in detail. Current Ic shown in FIG. 11(*a*) is a common mode current of the difference between Ia and Ik. If this common mode current Ic can be removed from between Ia and Ik, phases of Ia and Ik can be equalized and the unbalance voltage disappears at the same time. That is, while the tube voltage is applied, the unbalance voltage can be always removed by keeping a ratio obtained by performing division between two current values Ia and Ik flowing respectively through two primary windings 31*a* and 31*k* at an identical time point to be a predetermined ratio 1.

According to Embodiment 1, as the waveform phase difference removing means, a toroidal core (which has a high AL value and with which an inductance equal to or larger than leakage inductances 35*a* and 35*k* can be obtained) made of ferromagnetic material having a very high permeability is used as first core 6. Meanwhile, "AL value" is a characteristic value of the core acquired by normalizing for one turn a value of inductance obtained when a conductor is wound around the core for N turns, the unit being $iH/N^2$.

First bonding conductor 37*a* connecting first primary winding 31*a* through which first resonance current Ia flows with an output terminal of inverter 2 and second bonding conductor 37*b* connecting second primary winding 31*k* through which second resonance current Ik flows with the output terminal of inverter 2 are passed through first core 6 so that currents Ia and Ik flow in reverse directions. Since the directions of two resonance currents Ia and Ik are opposite, directions of magnetic fluxes generated to core 6 become opposite, waveforms and phases thereof are approximated, and the waveforms of two resonance currents are superposed. Eventually, the magnetic flux disappears.

Since core 6 used in the present invention has a very high AL value and it works as a greatly large impedance against the difference between the two resonance current waveforms, it can promptly cancel common mode current Ic and equalize two resonance currents Ia and Ik.

As described above, since the waveforms and the phases of two resonance currents Ia and Ik connected to inverter 2 being a common power supply can be equalized, electric power (voltage ×current) supplied to first secondary winding 32*a* and electric power supplied to second secondary winding 32*k* are equalized and the difference (unbalance voltage) in the tube voltage between the anode side and the cathode side can be cancelled.

Further, in the above description first bonding conductor 37 and second bonding conductor 37*b* are just passed through toroidal core 6. However, bonding conductors through which two resonance currents Ia and Ik flow may be wound around this core for the same turn number in order to enhance the connection.

Meanwhile, as shown later in the structure of the high voltage transformer of FIG. 5, the iron cores of the combination of the first primary and secondary windings of the high voltage transformer of FIGS. 1 and 2 and of the combination of the second primary and secondary windings may be divided into left and right. In FIG. 2, upper and lower parts of figure-of-O shaped iron core 33 are divided into right and left parts.

With this structure, the combinations of the primary and the secondary windings are magnetically separated and effects on each other can be cancelled in comparison with the undivided iron core shown in FIG. 1. That is, when it is aimed to increase the first secondary current to be close to the second secondary current, the current flowing through the first primary winding is corrected so as to be increased by the waveform phase difference removing means.

At this time, if the iron core is divided, the magnetic flux stretches only to the first secondary winding, and so only the first secondary current increases. Meanwhile, if the iron core is not divided, the magnetic flux of the first primary winding may stretches further to the second secondary winding. In this case, the second secondary current also increases and the object to increase the first secondary current to approximate it to the second secondary current cannot be achieved. That is, by dividing each iron core, the offset voltage can be corrected more certainly.

Embodiment 2

Figure 3:
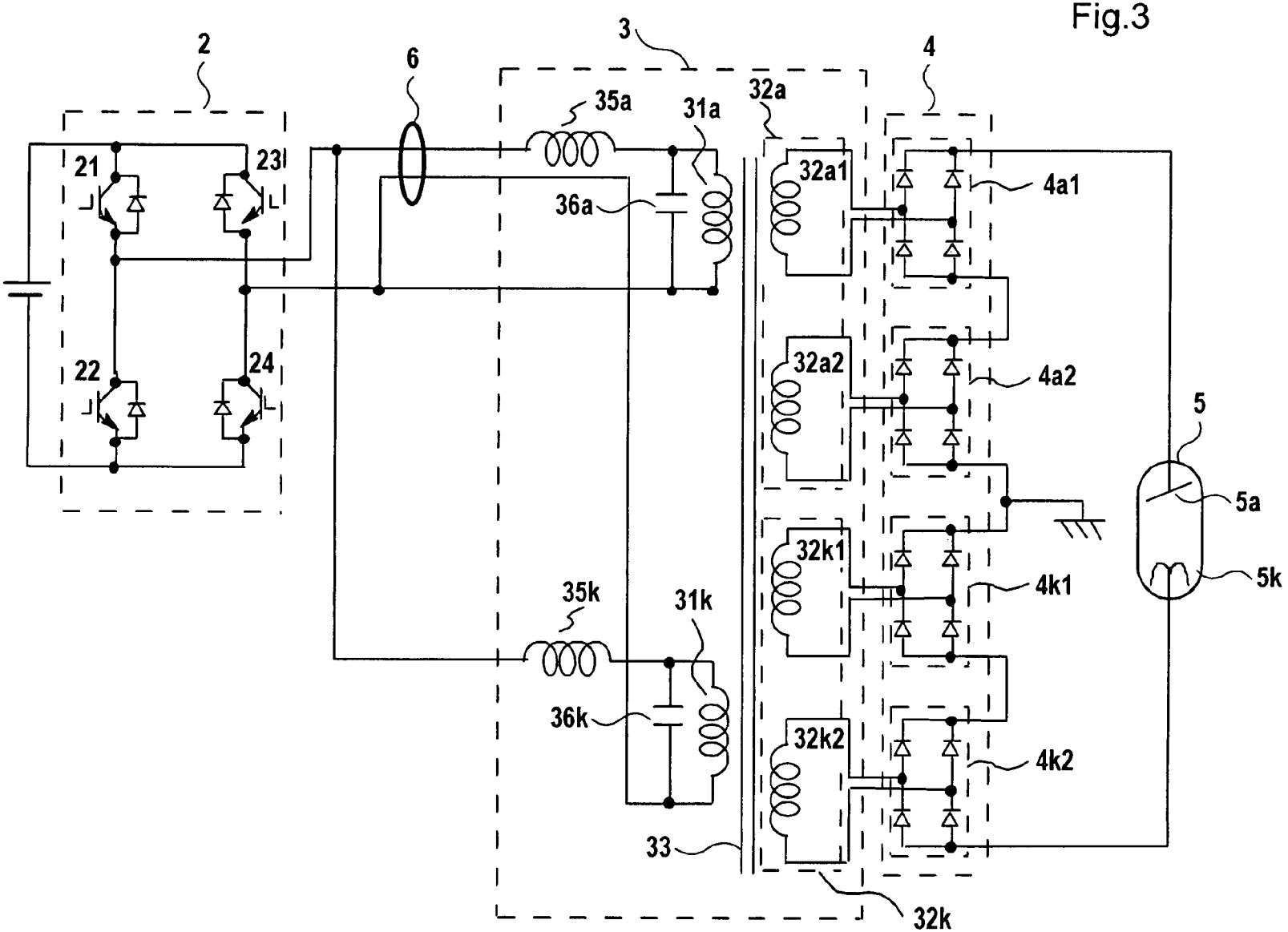
FIG. 3 is a diagram showing a structure according to Embodiment 2 of the present invention for removing an unbalance voltage generated due to difference in impedance of a high voltage transformer of an X-ray generating device.

In this embodiment, an X-ray high voltage device will be described in which the unbalance voltage due to (1) the difference in impedance of high voltage transformer described in the section of the background technique and in Embodiment 1 can be removed. FIG. 3 is a schematic diagram of an inverter-type X-ray high voltage device according to Embodiment 2, a main object of which is to remove the unbalance voltage generated due to impedance difference in the high voltage transformer. Similarly to Embodiment 1, the X-ray tube according to Embodiment 2 may be either a glass X-ray tube or a metal X-ray tube. FIG. 3 shows the case of the glass X-ray tube as in FIG. 1.

According to Embodiment 2, the secondary windings of high voltage transformer 3 and high voltage rectifier 4 are further divided than in Embodiment 1 shown in FIG. 1, wherein first secondary windings of the high voltage transformer is divided into 32*a*1 and 32*a*2, second secondary windings 32*k* is divided into 32*k*1 and 32*k*2, first high voltage rectifier 4*a* of high voltage rectifier 4 is divided into 4*a*1 and 4*a*2, and second high voltage rectifier 4*k* is divided into 4*k*1 and 4*k*2. The output voltage of thus divided first secondary winding 32*a*1 of high voltage transformer 3 is converted into a DC in first high voltage rectifier 4*a*1, the output voltage of first secondary winding 32*a*2 is converted into a DC in first high voltage rectifier 4*a*2. The DC output voltage of first high voltage rectifier 4*a*1 and of the DC output voltage of first high voltage rectifier 4*a*2 are added and applied between anode 5*a* and the earth of X-ray tube 5.

On the other hand, between the earth and cathode 5*k* of X-ray tube 5 is applied a voltage adding the output voltage of second secondary winding 32*k*1 of high voltage transformer 3 converted into DC in first high voltage rectifier 4*k*1 and the output voltage of second secondary winding 32*k*2 converted into DC in second high voltage rectifier 4*k*2. Other components including toroidal core 6 being the waveform phase difference removing means, which are similar to those in Embodiment 1 of FIG. 1, are omitted here.

By constructing the device as shown in FIG. 3, the unbalance voltage due to the difference in impedance of high voltage transformer 3 can be removed and a capacitance between layers of each secondary winding of the high voltage transformer becomes small. Further, since those secondary windings are connected in parallel, an equivalent stray capacitance changed into the primary side is small and a reactive current flowing through the equivalent stray capacitance is reduced during the period of light load with a small tube current, whereby the efficiency of the whole device is improved. In addition, because the secondary windings of high voltage transformer 3 and high voltage rectifier 4 are divided and the withstand voltage of thus divided secondary windings and high voltage rectifiers can be lowered, further miniaturization is possible. Particularly, because divided rectifiers 4*a*1, 4*a*2, 4*k*1, and 4*k*2 of high voltage rectifier 4 can be molded, further miniaturization can be expected.

Meanwhile, according to this embodiment, the division number of the secondary windings of high voltage transformer 3 and high voltage rectifier 4 is four. However, it is not limited thereto and may be larger than four in consideration of both reduction of reactive current due to stray capacitance of the high voltage transformer and miniaturization and mounting of the device.

Further, in the above description, first bonding conductor 37*a* and second bonding conductor 37*b* are just passed through common toroidal core 6. However, to further enhance the connection, the conductors through which two resonance currents Ia and Ik flow may be wound around this core for the same turn number. Even when the bonding conductors are just passed through the core, or when they are wound around the core for the same turn number, the ratio obtained by dividing current values Ia and Ik respectively flowing through two primary windings 31*a* and 31*k* each other is always kept to be a predetermined ratio 1 while the tube voltage is applied.

Meanwhile, according to this embodiment, the primary side of the high voltage transformer is divided into two windings and the secondary side is divided into four windings. However, both the primary and secondary sides may be divided into the larger number of windings. At this time, arbitrary windings on the primary side may be arranged in combination as described above. In this case, the number of windings to be passed through the toroidal core may be larger than two.

Further, when the number of primary windings is larger than two, primary currents from different windings are combined into a plurality of pairs and the ratio obtained by dividing current values I of the respective pairs each other is kept to be a predetermined ratio 1. For example, when the number of primary windings is four, four ways of combination of pairs are thinkable. Accordingly, by preparing four cores and passing the pairs through the respective cores, the removal of unbalance voltage can be accurately performed.

Meanwhile, as described in Embodiment 1, the iron core of the combinations of the first primary and secondary windings and of the second primary and secondary windings may be respectively divided.

Embodiment 3

In Embodiment 3, an X-ray high voltage device which can remove the unbalance voltage due to both the difference in impedance of the high voltage transformer described at (1) and the difference in load impedance described at (2) will be described. Since analysis of (1) generation of impedance of the high voltage transformer is described in Embodiment 1, the reason of (2) generation of the difference between Va and Vk (hereinafter referred to as "unbalance voltage") due to difference in impedance of the high voltage transformer will be analyzed and means for solving (1) and (2) according to this embodiment will be subsequently described.

The unbalance voltage due to (2) the difference in load impedance is generated in an inverter-type X-ray high voltage device using a metal X-ray tube, a part of a container of which is made of metal and grounded to the earth. As shown in FIG. 12, first high voltage rectifier 4*a* is connected with anode 5*a*' of X-ray tube 5' and second high voltage rectifier 4*k* is connected with cathode 5*k*'. A series connecting section of outputs of first high voltage rectifier 4*a* and second high voltage rectifier 4*k* is connected to metallic portion 51 of the container, and this connecting section is further connected to the earth. The output voltage of first and second rectifiers 4*a* and 4*k* is applied between anode 5*a*' and the earth and between cathode 5*k*' and the earth of the X-ray tube 5' to generate X-rays, as in a usual X-ray tube.

When this metal X-ray tube is used, referring to FIG. 12, output voltage of first secondary winding 3*c* of high voltage transformer 3 is rectified in first high voltage rectifier 4*a*, and current It flows in a circuit of first high voltage rectifier 4*a*, anode 5*a*' of X-ray tube 5', cathode 5*k*', and second high voltage rectifier 4*k*. At this time, a part of thermal electrons generated from cathode 5*k*' of X-ray tube 5' flows into the earth through metallic portion 51 of the container, and current Ic flows through a circuit of second high voltage rectifier 4*k*, metallic part 51 of X-ray tube 5', cathode 5*k*', second high voltage rectifier 4*k*.

That is, first secondary winding 3*c* supplies current It through first high voltage rectifier 4*a*, and second secondary winding 3*d* supplies currents It and Ic through second high voltage rectifier 4*k*. For this reason, in transformer 5' the current flowing through second secondary winding 3*d* is larger by Ic than that flowing through first secondary winding 3*c*.

Here, as described above, since high voltage transformer 3 can be separately thought as a first transformer including first primary winding 3*a* and secondary winding 3*c* and a second transformer including second primary winding 3*b* and secondary winding 3*d*, current Ib1 flowing through second primary winding 3*b* is larger than current Ia1 flowing through first primary winding 3*a*. That is, seen from the output side of inverter circuit 2, it can be regarded that among circuits supplying electric power to X-ray tube 5' the circuit of cathode 5*k*' has a lower load impedance than that of the circuit of anode 5*a*.

Figure 13:
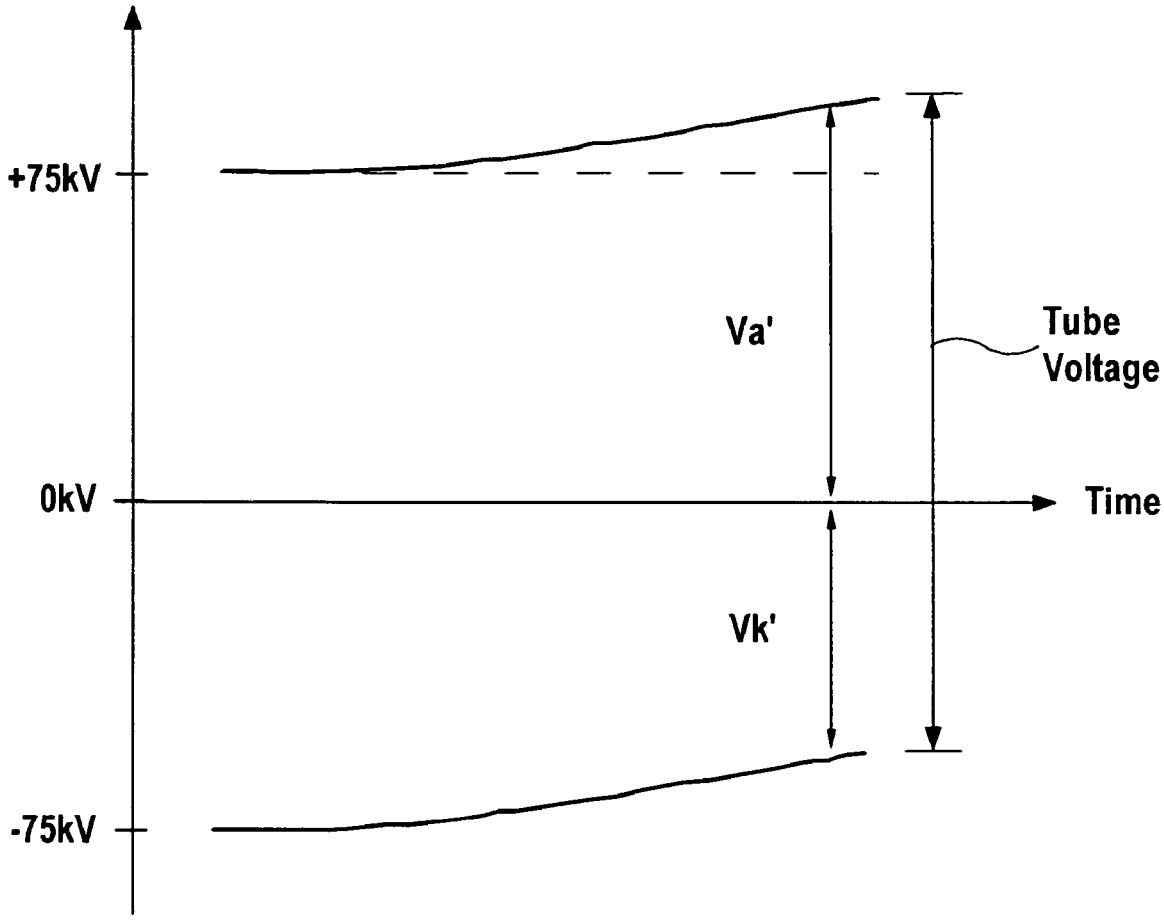
FIG. 13 is a diagram showing a voltage between an anode and an earth and a voltage between a cathode and the earth of a conventional X-ray generating device using a metal X-ray tube in the state that the unbalance voltage is generated therebetween.

In the case of usual metal X-ray tube, the impedance on the cathode side is lowered by 8% to 13%, even though it depends on the imaging conditions. Therefore, as shown in FIG. 13, difference occurs between voltage Va' between the anode and the earth and voltage Vk' between the cathode and the earth. The unbalance voltage generated due to this difference in load impedance becomes larger as tube voltage It becomes larger.

When the unbalance voltage due to difference in impedance of the high voltage transformer described above accompanies this unbalance voltage due to load difference, the difference between voltage Va between the anode and the earth and voltage Vk between the cathode and the earth of the X-ray tube further increases.

Figure 4:
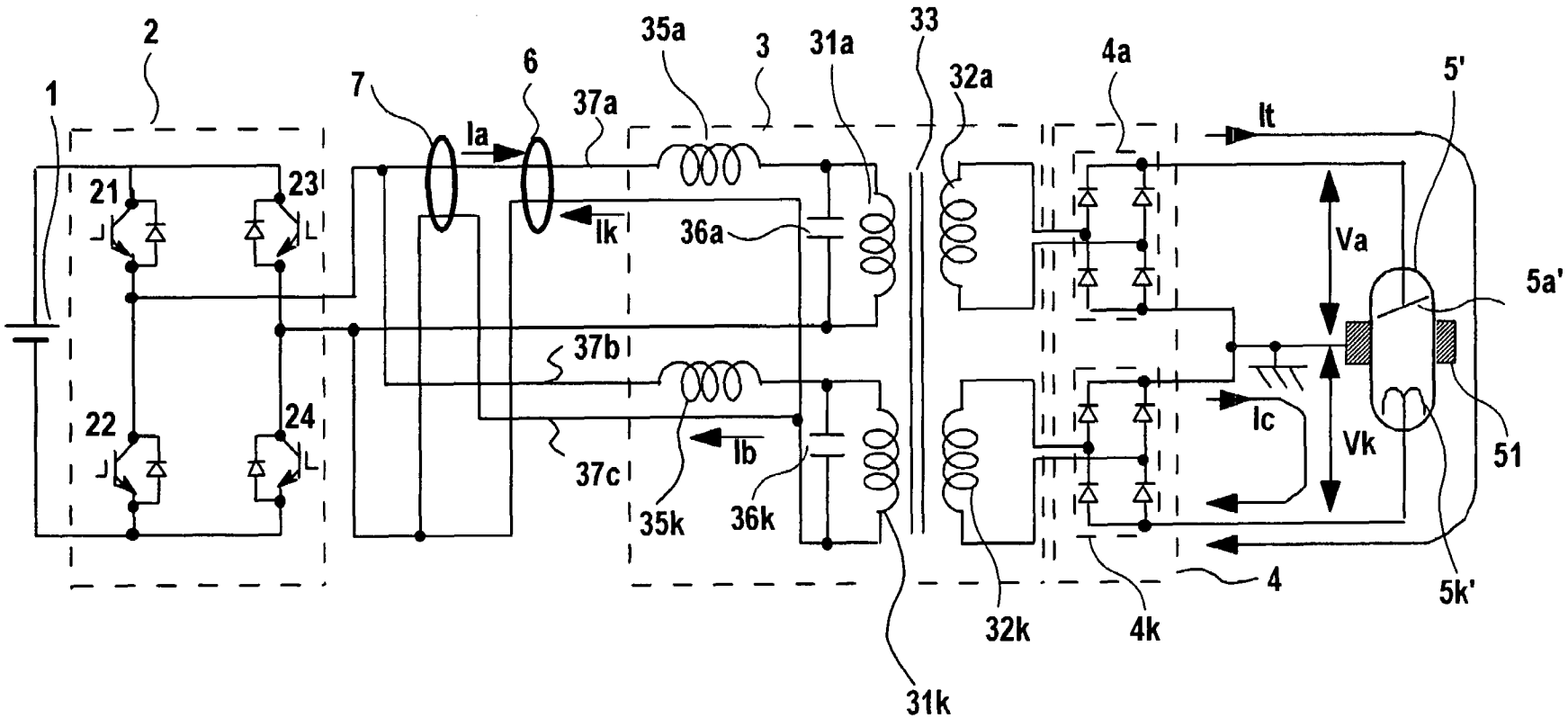
FIG. 4 is a diagram showing a structure according to Embodiment 3 of the present invention for removing the unbalance voltage generated due to difference in impedance of high voltage transformer and the unbalance voltage in load impedance of an X-ray generating device.

Embodiment 3 of the present invention will be described with reference to FIG. 4. FIG. 4 is a schematic block diagram showing the inverter-type X-ray high voltage device which can remove the unbalance voltage due to difference in impedance of the high voltage transformer and in load impedance.

According to this embodiment, a metal X-ray tube is used as an X-ray tube being a load of the inverter-type X-ray high voltage device according to the first embodiment shown in FIG. 1, and second cores 7 are provided as the current addition means between inverter 2 and the primary windings of high voltage transformer 3. In addition to the removal of unbalance voltage due to (1) difference in impedance of the high voltage transformer described in the section of the background technique and in Embodiment 1 by using first core 6 being the waveform phase difference removing means, (2) equalization of the tube voltage between the anode and the earth of the metal X-ray tube and the tube voltage between the cathode and the earth described in the section of background technique and at the front of this embodiment is also achievable at the same time.

In FIG. 4, first high voltage rectifier 4*a* is connected with anode 5*a*' of X-ray tube 5', while second high voltage rectifier 4*k* is connected with cathode 5*k*' of X-ray tube 5'. Metallic portion 51 of the X-ray tube container is connected to the series connecting section of first high voltage rectifier 4*a* and second high voltage rectifier 4*k*, this connecting section is grounded to the earth, and the output voltages of first and second rectifiers 4*a* and 4*k* are applied between anode 5*a*' and the earth and between the earth and cathode 5*k*' of X-ray tube 5' to generate X-rays, as in a usual X-ray tube.

To remove the unbalance voltage, a current raised by around 8 to 13%, which is larger than a current supplied to first primary winding 31*a*, is applied to second primary winding 31*k* so as to raise the output voltage of secondary winding 32*k*. As concrete means therefor, second core 7 having a high AL value for adding currents is provided between the output of inverter 2 and high voltage transformer 3 in addition to toroidal core 6 used in the first embodiment. The unbalance voltage due to the reason (2) can be always cancelled while the X-ray tube is applied by keeping the ratio obtained by dividing each other the plurality of current values Ia and Ik flowing respectively through two primary windings 31*a* and 31*k* at the same time point to be a ratio individually determined from circuit property in the range of 108 to 113% in consideration to the above mentioned 8 to 13%.

Figure 6:
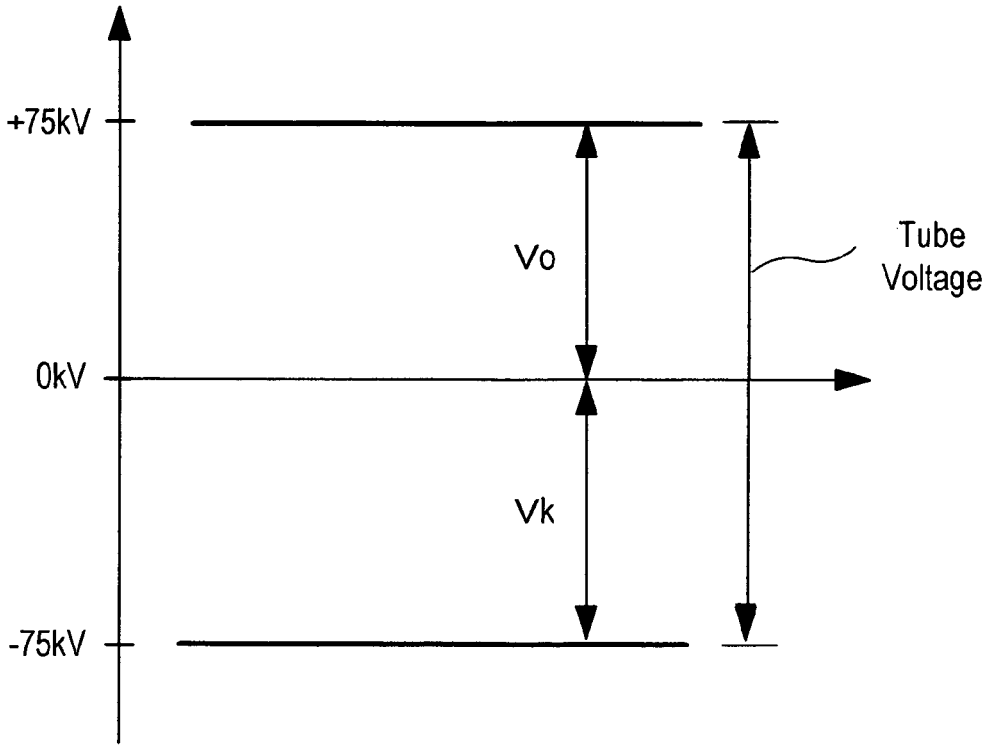
FIG. 6 is a diagram showing relationship among a tube current, a voltage between an anode and an earth, and a voltage between a cathode and the earth according to the structure of FIG. 4.

First bonding conductor 37*a* connecting first winding 31*a* through which first resonance current Ia flows with the output terminal of inverter 2 is passed through this core 7, and third bonding conductor 37*c* connecting the second primary winding and the output terminal of inverter 2 is also passed through the core 7 so that the flow direction of current Ib equivalent to 1/10 of current Ia is opposite to the direction of current Ia. For concrete example, third bonding conductor 37*c* diverted from a path of current after passing through second primary winding 31*k* is wound around core 7 for ten turns. With this structure, Ia and Ik of FIG. 4 are equally kept because of the operation of core mentioned in the first embodiment. At the same time, the magnetic flux of core 7 is kept to zero (or ampere turn is fixed). Accordingly, the following formulas are formed:

$$Ib = Ia/10 \tag{3}$$

$$\begin{aligned} Ib2 &= Ik + Ib \\ &= Ia + Ia/10 \\ &= 1.1 \cdot Ia \end{aligned} \tag{4}$$

and it becomes possible to make current value Ib of second primary winding 31*k* larger than current Ia of first primary winding 31*a* by around 10%. In this manner, by increasing the current value of the second resonance circuit having a low impedance, it becomes possible to equalize the tube voltages of the anode side and of the cathode side as shown in FIG. 6.

Meanwhile, although in above Embodiment 3 the winding number ratio of core 7 for current addition is 1:10, it is not limited thereto and an arbitrary winding number ratio may be selected in accordance with property of the X-ray tube. Further, because variation of impedance after manufacturing and secondary voltage above and below the neutral point in operation is measured and grasped in delivery inspection of the manufacture, an adequate winding number may be selected on the basis of measurement result so as to equalize the tube voltages on the anode side and on the cathode side. To select the adequate winding number ratio, for example, terminals are provided to a plurality of positions on the second core for adjusting the winding number.

Further, although the above embodiment is an example in which toroidal cores are applied to first core 6 as the waveform phase difference removing means and to second core 7 for current addition, the present invention is not limited thereto and other types of cores may be used as long as a sufficient AL value is obtainable.

Figure 5:
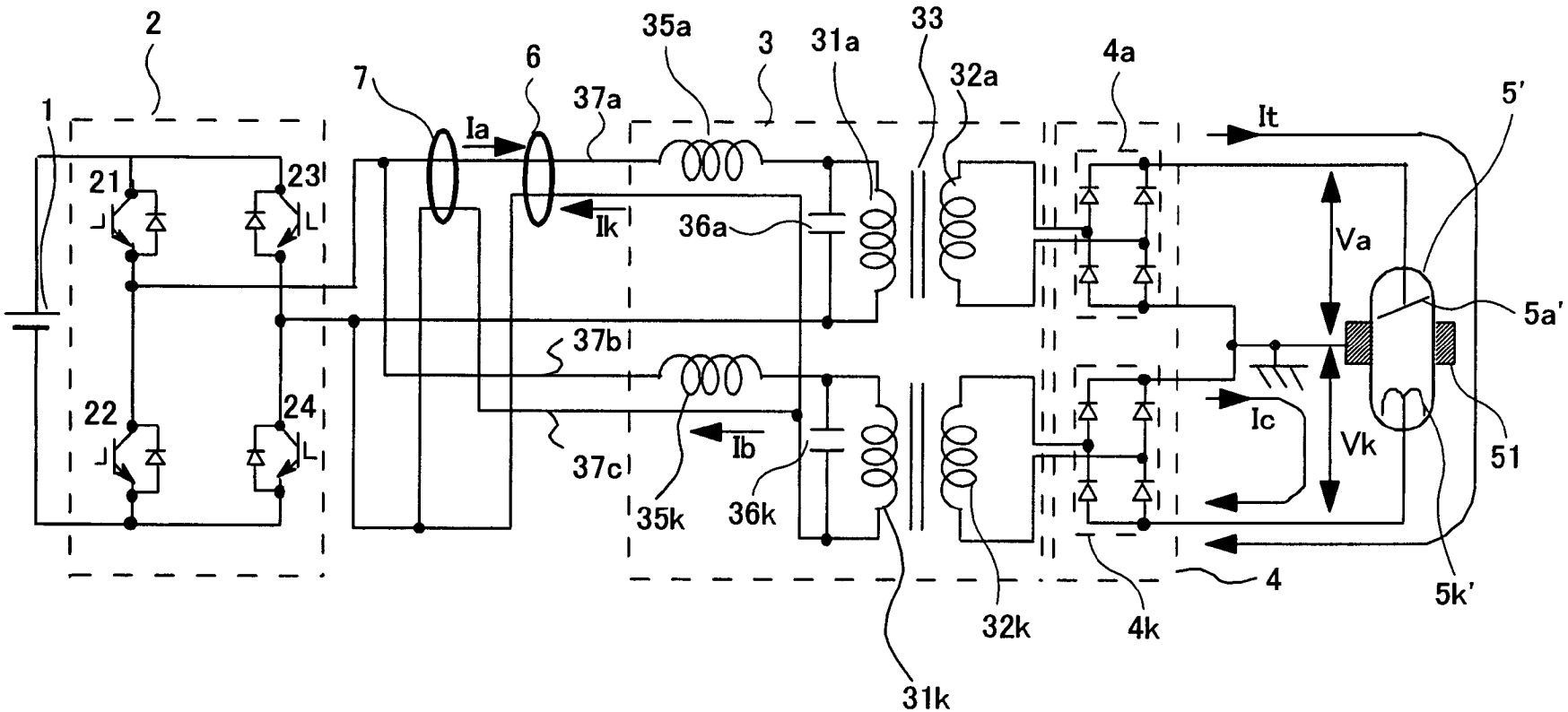
FIG. 5 is a diagram showing a structure of the high voltage transformer of FIG. 4, in which an iron core of first primary winding and first secondary winding and an iron core of a second primary winding and a second secondary winding are respectively divided.

Meanwhile, as shown in the structure of high voltage transformer of FIG. 5, the iron cores of the combination of first primary winding and first secondary winding and of the combination of second primary winding and second secondary winding of the high voltage transformer of FIG. 4 may be respectively divided. As mentioned in Embodiment 1, in FIG. 2 the upper and lower parts of figure-of-O iron core 33 are divided into left and right. With this structure, in comparison with the case that the iron core shown in FIG. 4 is not divided, the combinations of primary windings and the combinations of secondary windings are magnetically separated and the effects on each other can be reduced as mentioned in Embodiment 1.

Embodiment 4

Figure 7:
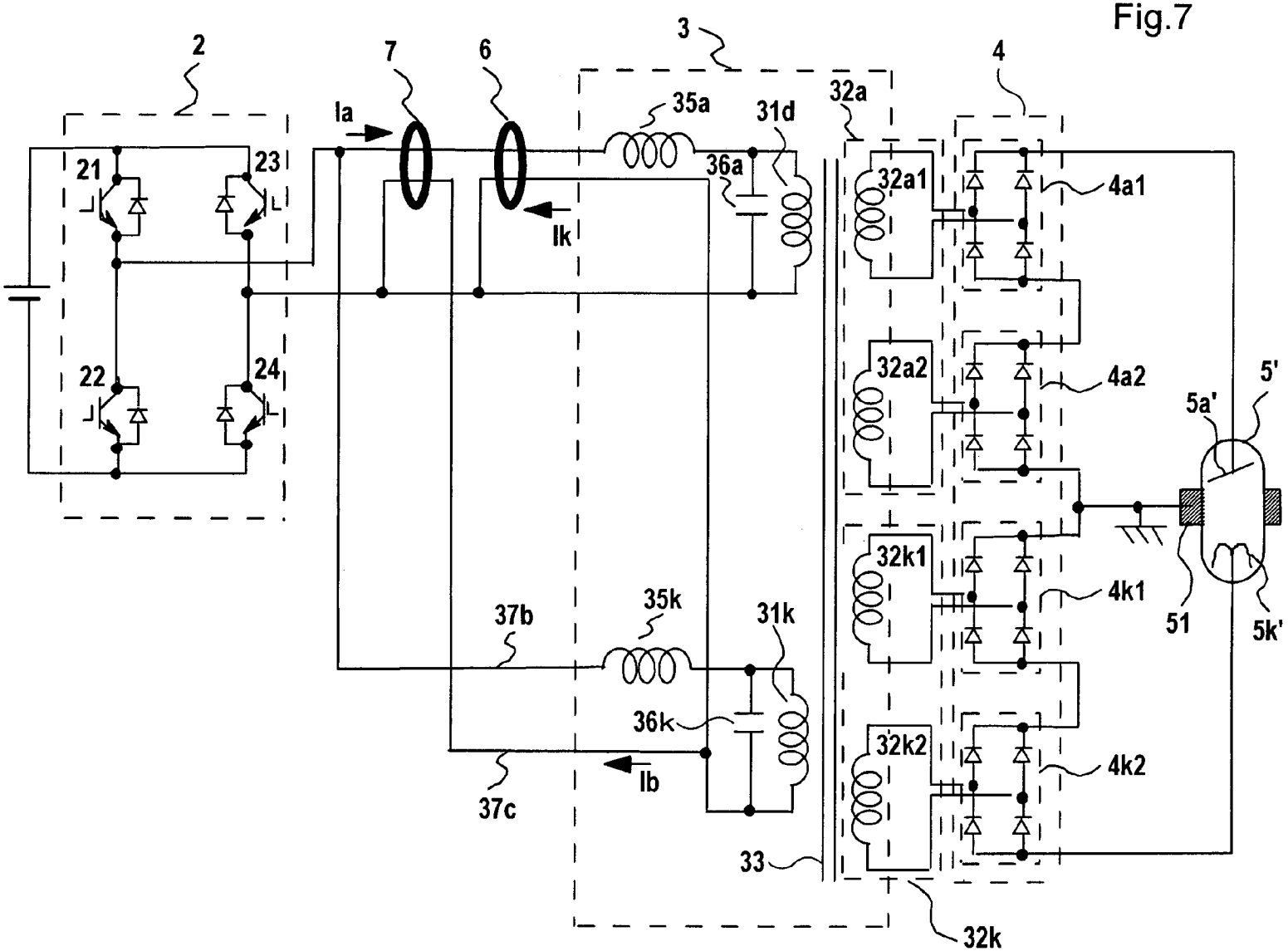
FIG. 7 is a diagram showing a structure according to Embodiment 4 of the present invention for removing the difference in the impedance of the high voltage transformer and the difference in the load impedance of the X-ray generating device.

FIG. 7 is a schematic block diagram showing the fourth embodiment of the inverter-type X-ray high voltage device according to the present invention in which the unbalance voltage due to difference in impedance of the high voltage transformer and in load impedance is removed.

According to Embodiment 4, secondary windings of high voltage transformer 3 and high voltage rectifier 4 are divided into more coils than in the embodiment of FIG. 3. First secondary winding 32*a* of high voltage transformer 3 is divided into 32*a*1 and 32*a*2, second secondary winding 32*k* is divided into 32*k*1 and 32*k*2, first high voltage rectifier 4*a* of high voltage rectifier 4 is divided into 4*a*1 and 4*a*2, and second high voltage rectifier 4*k* is divided into 4*k*1 and 4*k*2. An output voltage of thus divided first secondary winding 32*a*1 of high voltage transformer 3 is converted into a DC in first high voltage rectifier 4*a*1, the output voltage of first secondary winding 32*a*2 is converted into a DC in first high voltage rectifier 4*a*2, the voltage adding the DC output voltage of first high voltage rectifier 4*a*1 and the DC output voltage of first high voltage rectifier 4*a*2 is applied between anode 5*a*' and the earth of X-ray tube 5'.

On the other hand, between the earth and cathode 5*k*' of X-ray tube 5' is applied a voltage adding the output voltage of second secondary winding 32*k*1 of high voltage transformer 3 converted into the DC in first high voltage rectifier 4*k*1 and the output voltage of second secondary winding 32*k*2 converted into the DC in second high voltage rectifier 4*a*2.

Other components including first toroidal core 6 as the waveform phase difference removing means and second toroidal core 7 as the current addition means are similar to those described in Embodiment 3, and the description thereof is omitted.

By thus constructing the device as shown in FIG. 7, it becomes possible to remove the unbalance voltage due to the difference in impedance of high voltage transformer 3 and the difference between an impedance between the anode and the cathode and an impedance between the cathode and the anode of X-ray tube 5' being a load. Moreover, the capacitance between layers of each secondary winding of the high voltage transformer becomes small. Furthermore, since they are connected in series, the equivalent stray capacitance changed into the primary side is small, the reactive current flowing through the equivalent stray capacitance during a light load period with a small tube current is reduced, whereby the efficiency of the whole device is improved. In addition, since the secondary winding of the high voltage transformer 3 and high voltage rectifier 4 are divided, the withstand voltage of thus divided secondary winding and the high voltage rectifier can be reduced, whereby further miniaturization is possible.

Meanwhile, according to the embodiment of FIG. 7, the division number of the secondary winding of high voltage transformer 3 and of high voltage rectifier 4 is four. However, the present invention is not limited thereto and the division number may be larger than four in consideration of both the reduction of the reactive current due to the stray capacitance of the high voltage transformer and the miniaturization and mounting of the device.

Further, according to Embodiment 4 shown in FIG. 7, the winding number ratio of current addition core 7 is 1:10. However, it is not limited thereto and an arbitrary winding number ratio may be selected in accordance with property of the X-ray tube.

Further, since variation of the impedance after manufacturing high voltage transformer 3 and the secondary voltage above and below the neutral point in operation can be measured and grasped in delivery inspection of the manufacture, an adequate winding number ratio may be selected on the basis of the measurement result so as to equalize the tube voltages on the anode side and on the cathode side. To select the adequate winding number ratio, a plurality of terminals may be provided to the second core so as to adjust the winding number as in the embodiment of FIG. 4.

Further, according to this embodiment, the toroidal coils are used as first core 6 being the common current removing means and as second core 7 for current addition. However, the present invention is not limited thereto and other types of core may be used as long as a sufficient AL value is obtainable.

Furthermore, although first boding conductor 37*a* and second bonding conductor 37*b* are just passed through toroidal core 6 and first bonding conductor 37*a* and third bonding conductor 37*c* are passed through toroidal core 7, bonding conductors through which two resonance currents Ia and Ik flow may be wound around the cores for the same turn number to enhance the connection.

While the tube voltage is applied, a ratio obtained by dividing each other the plurality of current values Ia and Ik flowing respectively throguh two primary windings 31*a* and 31*k* is always kept within the range of 108 to 113% mentioned in Embodiment 3, and thus formed ratio is held by an additional core and two primary conductors passed through or wounded around this core, whereby the unbalance voltage due to reason (2) can be cancelled and the unbalance voltage generated due to reason (1) can also be adjusted.

Further, when the number of primary windings is larger than two, primary currents from another winding are combined into plural pairs and a ratio obtained by dividing each other current values I of the respective pairs is kept to a predetermined ratio 1. For example, when the number of primary windings is four, four manners of the pair combination are thinkable. Accordingly, by preparing four cores and penetrating the pairs through the respective cores, the removal of unbalance voltage can be accurately performed.

Meanwhile, according to this embodiment, the primary side of the high voltage transformer is divided into two windings, and the secondary side is divided into four windings. However, both the primary and secondary sides may be divided into the larger number of windings. At this time, arbitrary primary windings may be arranged in combination as described above. In this case, too, the number of windings wound around the toroidal core may be larger than two.

As shown in above Embodiments 1 to 4, by providing the waveform phase difference removing means and the current addition means between the output side of the inverter and the primary windings of the high voltage transformer, it is possible to reduce the difference between the voltage between the anode and the earth and the voltage between the cathode and the earth generated due to difference in impedance of the high voltage transformer and the difference in the load impedance. In this manner, it is possible to lower to the minimum the withstand voltage of the X-ray tube, the high voltage transformer, the high voltage rectifier, and the high voltage parts attaching thereto, whereby the X-ray high voltage device can be further miniaturized and lightweighted.

Meanwhile, although the above embodiments are described for the case of the X-ray generating device combining the inverter-type X-ray high voltage device and the X-ray tube, the present invention is not limited thereto and may be applied to any kind of X-ray high voltage device of the neutral grounding system. Further, in the case that it is unnecessary to reduce both unbalance voltage due to the difference in circuit impedance and that due to the difference in load impedance, either of them may be independently utilized.

Meanwhile, as mentioned in Embodiment 1, the iron cores of the combination of the first primary windings and the first secondary windings and the combination of the second primary windings and the second secondary windings in the high voltage transformer may be divided.

Embodiment 5

Figure 8:
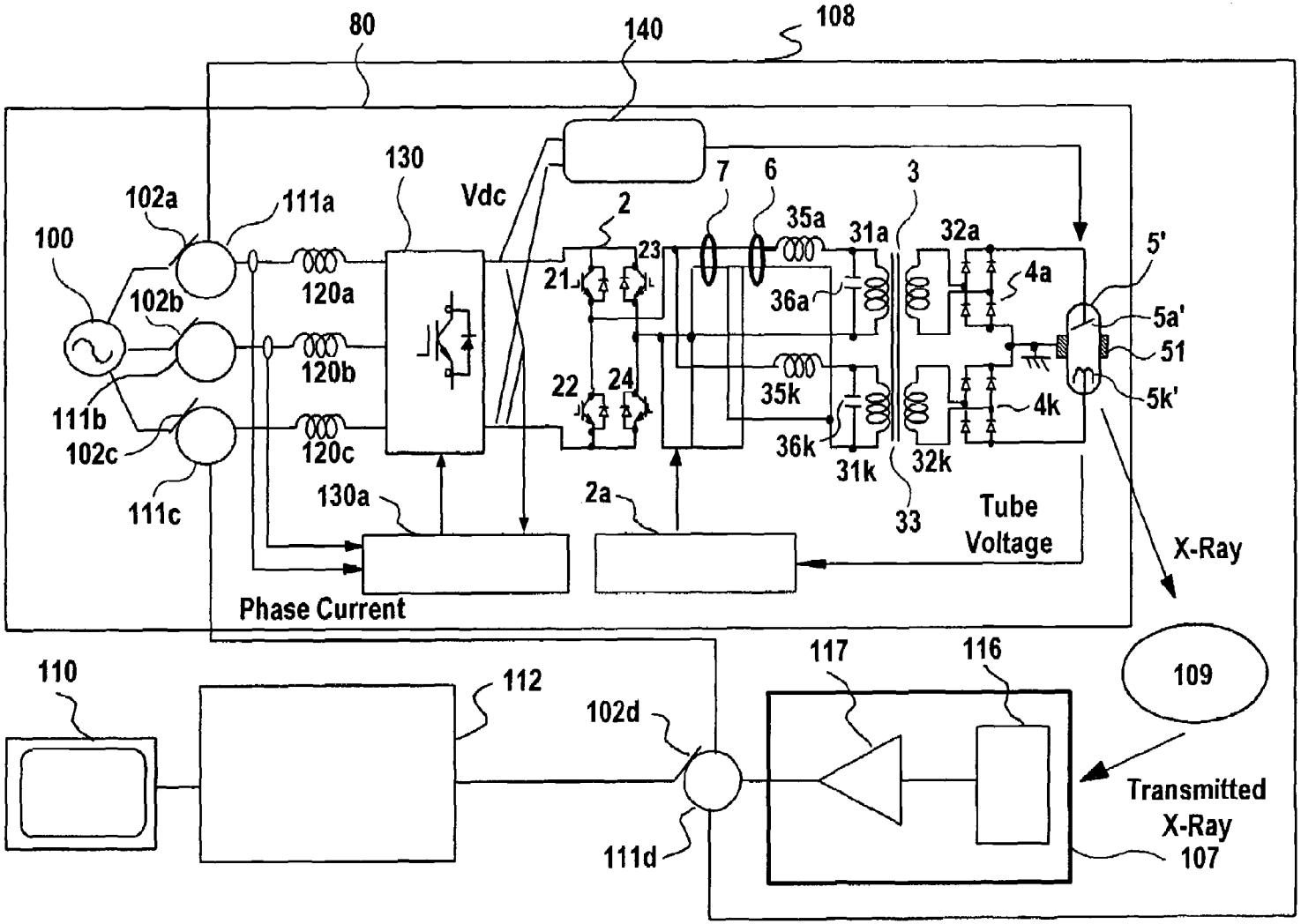
FIG. 8 is a diagram showing a structure of an X-ray CT apparatus according to Embodiment 5 of the present invention in which, e.g. the X-ray generating device shown in FIG. 4 is mounted on a scanner rotation unit.

In Embodiment 5, an X-ray CT apparatus using the inverter-type X-ray high voltage device shown in FIG. 8 will be described. FIG. 8 is a diagram showing the structure of X-ray CT apparatus mounting the X-ray high voltage device shown in FIG. 4 with a metal X-ray tube being a load on a scanner rotation unit. The X-ray generating device according to this embodiment includes a power transmission mechanism having slip rings for supplying an AC voltage of the power supply via the AC power supply and brushes, a pulse width modulation control type DC-AC conversion circuit (disclosed in Japanese Unexamined Patent Publication No.Hei.7-65987, hereinafter referred to as "high power factor AC-DC boost converter") having a boosting function and a high power factor function, an inverter, a high voltage transformer, a metal X-ray tube, and the like.

In FIG. 8, reference number 100 represents a three-phase AC power supply of 50 Hz or 60 Hz frequency, reference numbers 102*a*, 102*b*, and 102*c* represents brushes connected to AC power supply 100 for transmitting the AC voltage to scanner rotation unit 108, and reference numbers 111*a*, 111*b*, and 111*c* represent slip rings rotating along with scanner rotation unit 108 while contacting brushes 102*a*, 102*b*, and 102*c*. Brushes 102*a*, 102*b*, and 102*c* and slip rings 111*a*, 111*b*, and 111*c* form a power transmission mechanism.

Reference numbers 120*a*, 120*b*, and 120*c* represent inductors inserted in series to each phase of AC power supply 100, reference number 130 represents a high power factor AC-DC boost converter formed with inductors 120*a*, 120*b* and 120*c* and connected to these inductors, and reference number 121 represents a condenser for smoothing the output voltage of high power factor AC-DC boost converter 130. Because inverter 2 to metal X-ray tube 5' for converting the output DC voltage of AC-DC converter 130 into a high-frequency AC are similar to those according to Embodiment 4 mentioned above, the description will be omitted.

Reference number 130*a* represents a control circuit of the converter for controlling AC-DC converter 130 while detecting a current supplied to high power factor AC-DC boost converter 130 and the output DC voltage thereof via slip rings 111*a*, 111*b*, and 111*c*, and reference number 2*a* represents an inverter control circuit for detecting and inputting the DC high voltage supplied to X-ray tube 5' (tube voltage) and controlling inverter 2 so that thus detected tube voltage is a predetermined voltage. Reference number 140 represents an anode rotation driving circuit connected to the output side of high power factor AC-DC boost converter 4 for generating a DC of around 50 Hz to 200 Hz from DC voltage Vdc and driving the anode of X-ray tube 5' to rotate, which has a structure and functions similar to an usual inverter for an induction motor.

X-ray generating device 80 is constructed as described above. X-rays radiated from X-ray tube 5' are detected by detector 116 forming X-ray detection unit 107 after passing through object 109 to be examined, and amplified by amplifier 117. Reference number 111*d* represents a slip ring mounted on scanner rotation unit 108, reference number 102*b* represents a brush for transmitting an X-ray detection signal output from amplifier 117 while contacting slip ring 111*d*, reference number 112 represents an image processing device for generating a tomographic image from the X-ray detection signal transmitted from brush 102*d*, and reference number 110 represents an image display device connected to image processing device 112 for displaying the generated tomographic image. In this manner, X-ray generating device 80 and X-ray detection unit 107 are mounted on scanner rotation unit 108. An X-ray CT apparatus according to the present invention is formed by three units including scanner rotation unit 108, a bed on which object 109 (not shown) is placed, and a console (not shown) including image processing device 112 and image display device 110.

Next, the operations of thus constructed X-ray CT apparatus will be described.

After positioning the object on the bed, various conditions including slice position, number of scan, time of scan, tube voltage, tube current, and the like are set on the console (not shown). Scanner rotation unit 108 is activated by a scanner driving unit (not shown) on the basis of an operation command from the console and its rotation is accelerated to a predetermined rotation speed at which scan can be performed. Meanwhile, X-ray generating device 80 works so that input currents to slip rings 111*a*, 111*b*, and 111*c* are sine waves, phases of the above input currents and the voltages input to slip rings 111*a*, 111*b*, and 111*c* are equalized to adjust the power factor to be around 1, and DC output voltage Vdc is raised to be higher than the peak value of voltage of AC power supply 100.

That is, it has a function of raising the power factor and the voltage. Since the structure and operation of the X-ray high voltage device using the AC-DC converter having those functions is disclosed in Japanese Unexamined Patent Publication No.Hei.7-65987, the detailed description is omitted. AC-DC converter 130 is constructed by connecting inductors 120*a*, 120*b*, and 120*c* between the DC power supply output from slip rings 111*a*, 111*b*, and 111*c* and converter 130, connecting self turn-off type switching elements, e.g. insulated gate bipolar transistors (hereinafter abbreviated as "IGBT") between the above inductors and each of the positive and negative sides of DC output of converter 130 to form a full-bridge three-phase full wave rectifier, and reverse-parallel connecting diodes to those self turn-off switching elements.

Current input to this converter 4 is detected and the phases of input current and input voltage of the inverter are equalized. The switching elements are subjected to pulse width modulation (hereinafter abbreviated as "PWM") control in converter control circuit 130*a* so as to adjust the DC output voltage of converter 130 to be a predetermined voltage.

By applying the high power factor AC-DC boost converter having those functions to the X-ray generating device, it is possible to minimize the current flowing through slip rings 111*a*, 111*b*, and 111*c*. That is, when the full-bridge three-phase full wave rectifier circuit having a conventional diode or thyristor is used, the ratio between the active power input from the AC power supply to this rectifier circuit and the apparent power, i.e. the power factor is 0.4 to 0.6.

In the case of using the high power factor AC-DC boost converter which can take in power while power factor is 1, input current taken from AC power supply 100 into converter 130 is 1/2.5 to 1/6.7 with respect to the above full wave rectifier circuit using a conventional diode or thyristor, and a waveform of this input current is a sine wave. Accordingly, it is possible to make small the current flowing through the slip rings and the brushes and to reduce heat generation caused by power loss generated on a contact surface. Further, since the frequency of current flowing through the slip rings is 50 Hz or 60 Hz, which is remarkably lower than that in the case that output of 20 kHz inverter is transmitted, loss due to eddy current generated on the slip rings is also reduced.

As a result, the power loss of the power transmission mechanism including the slip rings and the brushes is greatly reduced and an X-ray generating device of high reliability can be constructed. Moreover, the capacity of the AC power supply may be 60 to 70% of that in the conventional AC power supply. Further, in high power factor AC-DC boost converter 130 shown in FIG. 8, electromagnetic energy can be charged into inductors 120*a*, 120*b*, and 120*c* by PWM-controlling the self turn-off type switching elements. Therefore, it is possible to charge a voltage larger than the peak voltage of AC power supply 100 into smoothing condenser 121 by discharging this electromagnetic energy to the smoothing condenser.

That is, the X-ray generating device has a boost function for raising DC output voltage Vdc to be larger than the peak value of the AC input voltage, which can operate inverter 2 connected to the output side of high power factor AC-DC boost converter 130 with a high voltage, effectively reduce the stray capacitance of the secondary windings of high voltage transformer 3 seen from the primary side, and accordingly reduce currents of inverter 2 and of primary windings of high voltage transformer 3, whereby the loss generated in the circuit is greatly reduced.

Thus boosted output voltage of converter 130 is converted into an AC with a frequency higher than that of commercial power supply 100 in inverter 2, this voltage is boosted in high voltage transformer 3, and the boosted AC voltage is converted into a DC in high voltage rectifiers 4*a* and 4*b* and applied to metal X-ray tube 5'. The unbalance voltage due to the difference between voltage Va' between the anode and the earth of X-ray tube 5' and voltage Vk' between the cathode and the earth generated due to difference between the impedance of the first transformer including first primary winding 31*a* and second winding 32*a*, leakage inductance 35*a*, and stray capacity 36*a* in the high voltage transformer and the impedance of the second transformer including second primary winding 31*k* and secondary winding 32*k*, leakage inductance 35*k*, and stray capacitance 36*k* is removed in waveform phase difference removing means 6, and the unbalance voltage due to the difference between voltage Va' between the anode and the earth and voltage Vk' between the cathode and the earth generated due to difference between impedance between the anode and the earth of X-ray tube 5' and impedance between the cathode and the earth is removed in current addition means 7.

By supplying the DC high voltage boosted by the high power factor AC-DC boost converter constructed as above to anode driving circuit 140 of metal X-ray tube 5', a three-phase or single-phase AC voltage of adequate voltage and frequency is generated and applied to a rotative anode driving mechanism (not shown) of X-ray tube 5' to drive the anode of the X-ray tube. Since the structure and the operations of this anode rotation driving circuit 140 are described in detail in Japanese Unexamined Patent Publication No.2000-150193, the detailed description is omitted here.

With the above operations, scanner rotation unit 108 is rotated, a DC power voltage value of inverter 2 of X-ray generating device 80 is set to a value according to the imaging tube voltage, and this voltage is input to anode rotation driving circuit 140 to rotate anode 5*a'* of X-ray tube 5' at a predetermined rotation speed, and thus, preparation for imaging is done.

When the rotation of scanner rotation unit 108 reaches a rotation speed corresponding to the scan time, the scan is started, inverter 2 operates so that the tube voltage according to the imaging conditions is applied to X-ray tube 5' and the tube current flows, and X-rays according to the imaging conditions are radiated from X-ray tube 5. After the radiated X-rays passes through object 109, they are detected by detector 116 forming X-ray detection unit 107, amplified by amplifier 117, and taken and stored into image processing device 112 via the transmission mechanism including slip ring 111*d* and brush 102*d*. When the scanner rotates at a predetermined constant rotation speed, object transmission data within a predetermined range are collected, various corrections including a correction for properties of X-ray detector are performed to acquire projection data, those data are stored into image processing device 112 and used for performing image reconstruction processing, and a reconstructed tomographic image is displayed on image display device 110.

Meanwhile, as mentioned in Embodiment 3, the inverter-type X-ray high voltage device in which the iron core of the high voltage transformer of FIG. 5 is divided may be used instead of the inverter-type X-ray high voltage transformer of FIG. 4. In this case, the correction of offset voltage is performed more accurately.

As described above, according to the X-ray CT apparatus of the present invention, the waveform phase difference removing means and the current addition means are provided between the output side of the inverter of the X-ray generating device and the primary windings of the high voltage transformer, whereby it is possible to reduce the difference between the voltage between the anode and the earth of X-ray tube and the voltage between the cathode and the earth occurring due to the difference in impedance of the high voltage transformer and the difference in load impedance.

Therefore, since the withstand voltage of not only the X-ray tube but also the high voltage transformer, the high voltage rectifier, and the high voltage parts attaching thereto can be lowered to the minimum, the X-ray generating device is miniaturized and lightweighted and the X-ray CT apparatus of rapid scan based on reduction of scanner weight can be realized.

Commercial Availability

As described above, since the waveform phase difference removing means and the current addition means are provided in the X-ray high voltage device of the neutral grounding system, the difference between voltage between the anode and the earth and voltage between the cathode and the earth occurring due to the difference in impedance of the high voltage transformer and difference in load impedance can be reduced.

Therefore, since the withstand voltage of not only the X-ray tube but also the high voltage transformer, the high voltage rectifier, and the high voltage parts attaching thereto can be lowered to the minimum, stability and reliability of the device can be maintained even when the X-ray generating device is miniaturized and lightweighted. Particularly, by using the X-ray high voltage device of the inverter-type, the high voltage transformer is miniaturized and lightweighted while maintaining its stability and reliability since the operation frequency of the inverter becomes high, and the high voltage transformer is miniaturized and lightweighted.

Further, by mounting the above described X-ray generating device on the scanner of the X-ray CT apparatus, rapid scan with stable operation is realized and an X-ray CT apparatus which is also available in cardiac imaging and the like can be provided.

The invention claimed is:

1. An X-ray generating device comprising:

a high voltage transformer for boosting an AC power voltage including a plurality of primary windings connected in parallel to an AC power supply, at least one iron core, and a plurality of secondary windings;

a plurality of high voltage rectifier circuits which are connected to outputs of the plurality of secondary windings of the high voltage transformer and converts the outputs into DC outputs, connects the DC in series, and grounds the midpoints of the series connection at a neutral point; and an X-ray tube receiving a predetermined tube voltage through a cathode and an anode thereof, respectively connected to a DC output negative terminal and a DC output positive terminal on both ends of the plurality of high voltage rectifier circuits, in which a waveform phase difference removing means is provided to remove a difference in waveform and phase occurring between plural currents respectively flowing through plural windings and to remove an unbalanced voltage, wherein the waveform phase difference removing means has a hollowed core made of a ferromagnetic material of large permeability, and wherein a part of plural conductors connecting the primary windings and the AC power supply passes through or turns around the hollow, and differences in waveforms and phases are removed by mutually canceling magnetic fields generated due to the primary winding currents.

2. An X-ray generating device according to claim 1, wherein the core has a high AL value, and gives an inductance equivalent to or larger than a leakage inductance of the high voltage transformer.

3. An X-ray generating device according to claim 1, wherein the AC power supply includes a DC power supply and an inverter for converting a current from the DC power supply into a high-frequency AC current.

4. An X-ray generating device according to claim 1, wherein the X-ray tube is a metal X-ray tube having a metallic part in a substantial center and the metallic part is connected to the grounded neutral point.

5. An X-ray generating device according to claim 4, wherein the predetermined ratio is smaller than 1.

6. An X-ray generating device according to claim 5 further comprising: current addition means formed by commonly winding two or more conductors among a plurality of conductors respectively connecting the plural primary windings and the AC power supply around a ferromagnetic core having a large permeability to keep the ratio between the plural current values are kept at a predetermined ratio.

7. An X-ray generating device according to claim 6, wherein the core has a high AL value and gives an inductance equivalent to or larger than a leakage inductance of the high voltage transformer.

8. An X-ray generating device according to claim 4, further comprising:

waveform phase difference removing means which lowers the predetermined ratio to be smaller than 1 and removes differences in waveform and phase generated between the plural currents respectively flowing through the plurality of primary windings; and current addition means formed by commonly winding two or more conductors among the plural conductors respectively connecting the plurality of primary windings and the AC power supply around the ferromagnetic core having a large permeability, wherein the ratio between the plural current values is kept at a predetermined ratio by the waveform phase difference removing means and the current addition means.

9. An X-ray generating device according to claim 8, wherein the waveform phase difference removing means has a hollowed core made of ferromagnetic material of a large permeability, a part of the plural conductors passes through or turns around the hollow, and the differences in waveforms and phases are removed by mutually canceling magnetic fields generated by the primary current.

10. An X-ray generating device according to claim 9, wherein the two cores have a high AL value and give an inductance equivalent to or larger than a leakage inductance of the high voltage transformer.

11. An X-ray CT apparatus comprising:

an X-ray generating device according to claim 1;

an X-ray detector arranged opposite to the X-ray tube;

a rotative circular plate holding the X-ray tube and the X-ray detector, and being driven to rotate around an object to be examined; and image reconstructing means for reconstructing a tomogram of the object as an image on the basis of the strength of X-rays detected by the X-ray detector.

12. An X-ray CT apparatus comprising:

an X-ray generating device according to claim 8;

an X-ray detector arranged opposite to the X-ray tube;

a rotative circular plate for holding the X-ray tube and the X-ray detector, and being driven to rotate around an object to be examined; and image reconstructing means for reconstructing a tomogram of the object as an image on the basis of the strength of X-rays detected by the X-ray detector.

13. An X-ray generating device according to claim 9, wherein a ratio obtained by dividing a plurality of values of currents respectively flowing through the plurality of primary windings at an identical time point is always kept at a predetermined ratio while the tube voltage is applied.

14. An X-ray generating device according to claim 13, wherein the predetermined ratio is 1.

15. An X-ray generating device according to claim 1 wherein the part of plural conductors comprise:

a first conductor which connects one output terminal of the non-resonant inverter and one input terminal of a first primary winding;

a second conductor which connects another output terminal of the non-resonant inverter and one input terminal of a second primary winding having a different potential level as the input terminal of the first primary winding, and the first conductor and the second conductor are bundled and pass through or turn around the hollow.

16. An X-ray generating device according to claim 8, wherein the part of plural conductors comprise:

a first conductor which connects one output terminal of the non-resonant inverter and one input terminal of a first primary winding;

a second conductor which connects another output terminal of the non-resonant inverter and one input terminal of a second primary winding having a different potential level as the input terminal of the first primary windings, and the second conductor is divided into two conductors and each of the two conductors is respectively bundled to the first conductor and pass through or turn around two hollows respectively.

* * * * *